US012065909B2

(12) United States Patent
Steele et al.

(10) Patent No.: US 12,065,909 B2
(45) Date of Patent: Aug. 20, 2024

(54) UNITARY LATERAL LEG WITH THREE OR MORE OPENINGS

(71) Applicant: Halliburton Energy Services, Inc., Houston, TX (US)

(72) Inventors: David Joe Steele, Carrollton, TX (US); Srinivasa Prasanna Vemuri, Frisco, TX (US); Stacey Blaine Donovan, Fort Worth, TX (US); Morten Falnes, Sola (NO); Wesley Paul Dietz, Carrollton, TX (US); Christian Alexander Ramirez, Irving, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/118,582

(22) Filed: Dec. 10, 2020

(65) Prior Publication Data

US 2021/0172265 A1 Jun. 10, 2021

Related U.S. Application Data

(60) Provisional application No. 62/946,219, filed on Dec. 10, 2019.

(51) Int. Cl.
*E21B 41/00* (2006.01)
*E21B 17/18* (2006.01)
(Continued)

(52) U.S. Cl.
CPC ..... *E21B 41/0035* (2013.01); *E21B 17/18* (2013.01); *E21B 23/00* (2013.01);
(Continued)

(58) Field of Classification Search
CPC ..... E21B 41/0035; E21B 17/18; E21B 23/00; E21B 23/02; E21B 41/0042; E21B 43/26; E21B 43/14; E21B 23/10; E21B 23/12
See application file for complete search history.

(56) References Cited

U.S. PATENT DOCUMENTS 3,542,404 A 11/1970 Crews
5,284,208 A 2/1994 Clemens et al.
(Continued)

FOREIGN PATENT DOCUMENTS

CN 105089565 11/2015
CN 106471209 3/2017
(Continued)

OTHER PUBLICATIONS

Dyer, S., et al., "New Intelligent Completion System Enables Compartment-Level Control in Multilateral Wells," Journal of Petroleum Technology, Aug. 15, 2016, vol. 68, Issue 9, 6 pages, https://pubs.spe.org/en/jpt/jpt-article-detail/?art=1385.

*Primary Examiner* — Jonathan Malikasim
(74) *Attorney, Agent, or Firm* — Scott Richardson; Parker Justiss, P.C.

(57) ABSTRACT

Provided is a multilateral leg bore, a multilateral junction, and a well system. The multilateral leg bore, in one aspect, includes a unitary housing having a first end and a second opposing end defining a length (L). In accordance with this aspect, the multilateral junction includes three or more bores formed in the housing and extending along the length (L).

15 Claims, 22 Drawing Sheets

(51) Int. Cl.

| | |
|---|---|
| ***E21B 23/00*** | (2006.01) |
| ***E21B 23/02*** | (2006.01) |
| ***E21B 23/12*** | (2006.01) |
| ***E21B 43/14*** | (2006.01) |
| ***E21B 43/26*** | (2006.01) |

(52) U.S. Cl.
CPC ..... *E21B 23/02* (2013.01); *E21B 41/0042* (2013.01); *E21B 43/26* (2013.01); *E21B 23/12* (2020.05); *E21B 43/14* (2013.01)

(56) References Cited

U.S. PATENT DOCUMENTS

| | | | | |
|---|---|---|---|---|
| 5,435,392 | A | 7/1995 | Kennedy | |
| 5,462,120 | A | 10/1995 | Gondouin | |
| 5,979,560 | A | 11/1999 | Nobileau | |
| 6,047,774 | A | 4/2000 | Allen | |
| 6,056,059 | A * | 5/2000 | Ohmer | E21B 7/061 166/117.6 |
| 6,089,320 | A | 7/2000 | LaGrange | |
| 6,276,457 | B1 | 8/2001 | Moffatt et al. | |
| 6,283,216 | B1 | 9/2001 | Ohmer | |
| 6,354,375 | B1 * | 3/2002 | Dewey | E21B 23/12 166/241.1 |
| 6,431,283 | B1 | 8/2002 | Dale | |
| 6,712,148 | B2 | 3/2004 | Fipke et al. | |
| 6,863,129 | B2 * | 3/2005 | Ohmer | E21B 17/203 166/50 |
| 6,907,930 | B2 | 6/2005 | Cavender et al. | |
| 6,915,847 | B2 | 7/2005 | Brockman | |
| 7,299,878 | B2 * | 11/2007 | Steele | E21B 41/0042 166/117.6 |
| 7,350,569 | B2 | 4/2008 | Collins et al. | |
| 7,779,924 | B2 | 8/2010 | Clamens | |
| 7,980,311 | B2 | 7/2011 | Dowling et al. | |
| 8,397,819 | B2 | 3/2013 | Tunget | |
| 8,695,694 | B1 | 4/2014 | Lajesic | |
| 8,701,775 | B2 | 4/2014 | Steele | |
| 8,967,277 | B2 | 3/2015 | Steele et al. | |
| 8,985,203 | B2 | 3/2015 | Stokes et al. | |
| 9,133,675 | B2 | 9/2015 | Telfer | |
| 9,133,697 | B2 | 9/2015 | Cavender et al. | |
| 9,140,082 | B2 | 9/2015 | Lajesic | |
| 9,140,102 | B2 | 9/2015 | Bartko et al. | |
| 9,194,213 | B2 | 11/2015 | Macleod et al. | |
| 9,243,465 | B2 | 1/2016 | Lajesic | |
| 9,260,945 | B2 | 2/2016 | Lajesic et al. | |
| 9,394,778 | B2 | 7/2016 | Anders | |
| 9,638,008 | B2 | 5/2017 | Stokes et al. | |
| 9,803,438 | B2 | 10/2017 | Stokes et al. | |
| 9,822,612 | B2 | 11/2017 | Steele et al. | |
| 9,874,062 | B2 | 1/2018 | Lajesic et al. | |
| 10,012,045 | B2 | 7/2018 | Lajesic | |
| 10,036,220 | B2 | 7/2018 | Lajesic et al. | |
| 10,060,225 | B2 | 8/2018 | Wolf et al. | |
| 10,167,684 | B2 | 1/2019 | Steele | |
| 10,196,880 | B2 | 2/2019 | Steele et al. | |
| 10,240,434 | B2 | 3/2019 | Steele et al. | |
| 10,352,140 | B2 | 7/2019 | Parlin et al. | |
| 10,435,993 | B2 | 10/2019 | Steele | |
| 10,465,452 | B2 | 11/2019 | Parlin | |
| 10,655,433 | B2 | 5/2020 | Hepburn et al. | |
| 10,731,417 | B2 | 8/2020 | Vemuri et al. | |
| 11,203,913 | B2 | 12/2021 | Martin et al. | |
| 11,371,305 | B2 | 6/2022 | Mickey et al. | |
| 2001/0025710 | A1 | 10/2001 | Ohmer et al. | |
| 2003/0029613 | A1 | 2/2003 | Danos et al. | |
| 2003/0062717 | A1 * | 4/2003 | Thomas | E21B 17/18 285/124.1 |
| 2005/0230121 | A1 | 10/2005 | Martinez et al. | |
| 2005/0241830 | A1 | 11/2005 | Steele | |
| 2007/0089875 | A1 | 4/2007 | Steele et al. | |
| 2007/0227727 | A1 | 10/2007 | Patel et al. | |
| 2010/0163240 | A1 | 7/2010 | Ingraham et al. | |
| 2010/0170677 | A1 | 7/2010 | Ingraham | |
| 2010/0276158 | A1 | 11/2010 | Ingraham | |
| 2012/0305268 | A1 | 12/2012 | Steele | |
| 2013/0081807 | A1 | 4/2013 | Dyer et al. | |
| 2013/0306324 | A1 | 11/2013 | Tunget | |
| 2014/0345861 | A1 | 11/2014 | Stalder et al. | |
| 2015/0068756 | A1 | 3/2015 | Pendleton | |
| 2015/0233190 | A1 | 8/2015 | Wolf et al. | |
| 2015/0275587 | A1 | 10/2015 | Wolf et al. | |
| 2015/0376955 | A1 | 12/2015 | Wolf et al. | |
| 2016/0273312 | A1 | 9/2016 | Steele et al. | |
| 2016/0290079 | A1 | 10/2016 | Lajesic | |
| 2016/0348476 | A1 | 12/2016 | Stokes et al. | |
| 2017/0130537 | A1 * | 5/2017 | Parlin | E21B 41/0035 |
| 2017/0328177 | A1 | 11/2017 | Sheehan et al. | |

FOREIGN PATENT DOCUMENTS

| | | |
|---|---|---|
| CN | 105829639 | 5/2019 |
| EP | 2358974 | 10/2016 |
| EP | 2715041 | 1/2019 |
| EP | 3025005 B1 | 3/2019 |
| RU | 2436925 C2 | 12/2011 |
| RU | 2518701 C2 | 6/2014 |
| RU | 2588999 C2 | 7/2016 |
| RU | 2608375 C2 | 1/2017 |
| RU | 2655517 C2 | 5/2018 |
| RU | 2687729 C1 | 5/2019 |
| RU | 2719842 C2 | 4/2020 |
| WO | 0026501 | 5/2000 |
| WO | 2015030842 A1 | 3/2015 |
| WO | 2016010530 A1 | 1/2016 |
| WO | 2019027454 A1 | 2/2019 |

* cited by examiner

UNITARY LATERAL LEG WITH THREE OR MORE OPENINGS

CROSS-REFERENCE TO RELATED APPLICATION

This application claims the benefit of U.S. Provisional Application Ser. No. 62/946,219, filed on Dec. 10, 2019, entitled "HIGH PRESSURE MIC WITH MAINBORE AND LATERAL ACCESS AND CONTROL", and incorporated herein by reference in its entirety.

BACKGROUND

A variety of selective borehole pressure operations require pressure isolation to selectively treat specific areas of the wellbore. One such selective borehole pressure operation is horizontal multistage hydraulic fracturing ("frac" or "fracking"). In multilateral wells, the multistage stimulation treatments are performed inside multiple lateral wellbores. Efficient access to all lateral wellbores is critical to complete successful pressure stimulation treatment.

BRIEF DESCRIPTION

Reference is now made to the following descriptions taken in conjunction with the accompanying drawings, in which:

FIG. 1 illustrates a well system for hydrocarbon reservoir production, the well system including a y-block designed, manufactured and operated according to one or more embodiments of the disclosure;

FIGS. 2A through 2C illustrated different views of a multilateral junction designed, manufactured and operated according to one or more embodiments of the disclosure;

DETAILED DESCRIPTION

Figure 1:
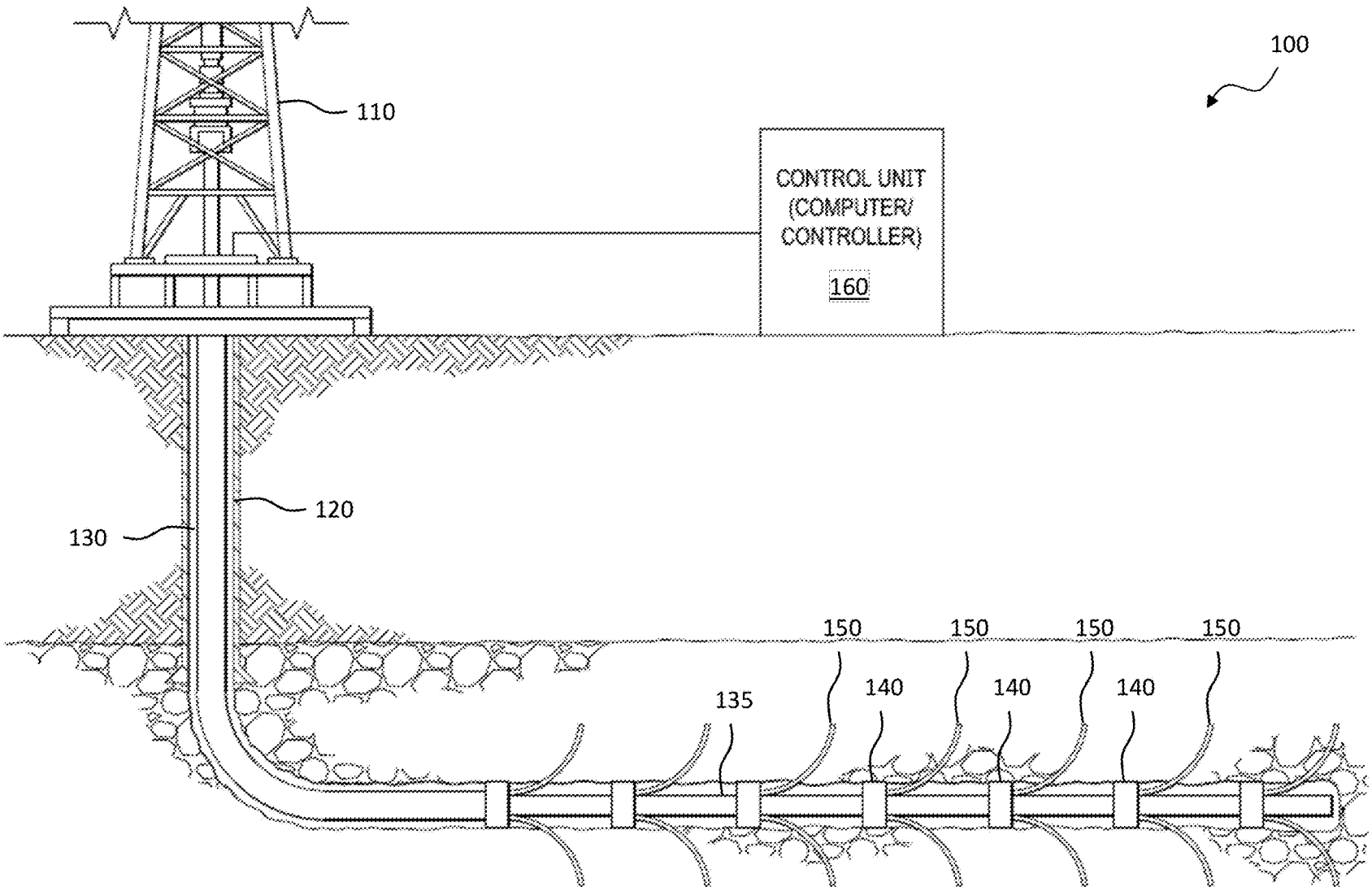

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to a direct interaction between the elements and may also include an indirect interaction between the elements described. Unless otherwise specified, use of the terms "up," "upper," "upward," "uphole," "upstream," or other like terms shall be construed as generally toward the surface of the ground; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. In some instances, a part near the end of the well can be horizontal or even slightly directed upwards. In such instances, the terms "up," "upper," "upward," "uphole," "upstream," or other like terms shall be used to represent the toward the surface end of a well. Unless otherwise specified, use of the term "subterranean formation" shall be construed as encompassing both areas below exposed earth and areas below earth covered by water such as ocean or fresh water.

A particular challenge for the oil and gas industry is developing a pressure tight TAML (Technology Advancement of Multilaterals) level 5 multilateral junction that can be installed in casing (e.g., 7 ⅝" casing) and that also allows for ID access (e.g., 3 ½" ID access) to a main wellbore after the junction is installed. This type of multilateral junction could be useful for coiled tubing conveyed stimulation and/or clean-up operations. It is envisioned that future multilateral wells will be drilled from existing slots/wells where additional laterals are added to the existing wellbore. If a side track can be made from the casing (e.g., 9 ⅝" casing), there is an option to install a liner (e.g., 7" or 7 ⅝" liner) with a new casing exit point positioned at an optimal location to reach undrained reserves.

Referring now to FIG. 1, illustrated is a diagram of a well system 100 for hydrocarbon reservoir production, according to certain example embodiments. The well system 100 in one or more embodiments includes a pumping station 110, a main wellbore 120, tubing 130, 135, which may have differing tubular diameters, and a plurality of multilateral junctions 140, and lateral legs 150 with additional tubing integrated with a main bore of the tubing 130, 135. Each multilateral junction 140 may comprise a junction designed, manufactured or operated according to the disclosure, including a multilateral bore leg according to the disclosure. The well system 100 may additionally include a control unit 160. The control unit 160, in this embodiment, is operable to control to and/or from the multilateral junctions and/or lateral legs 150, as well as other devices downhole.

Figure 2A:
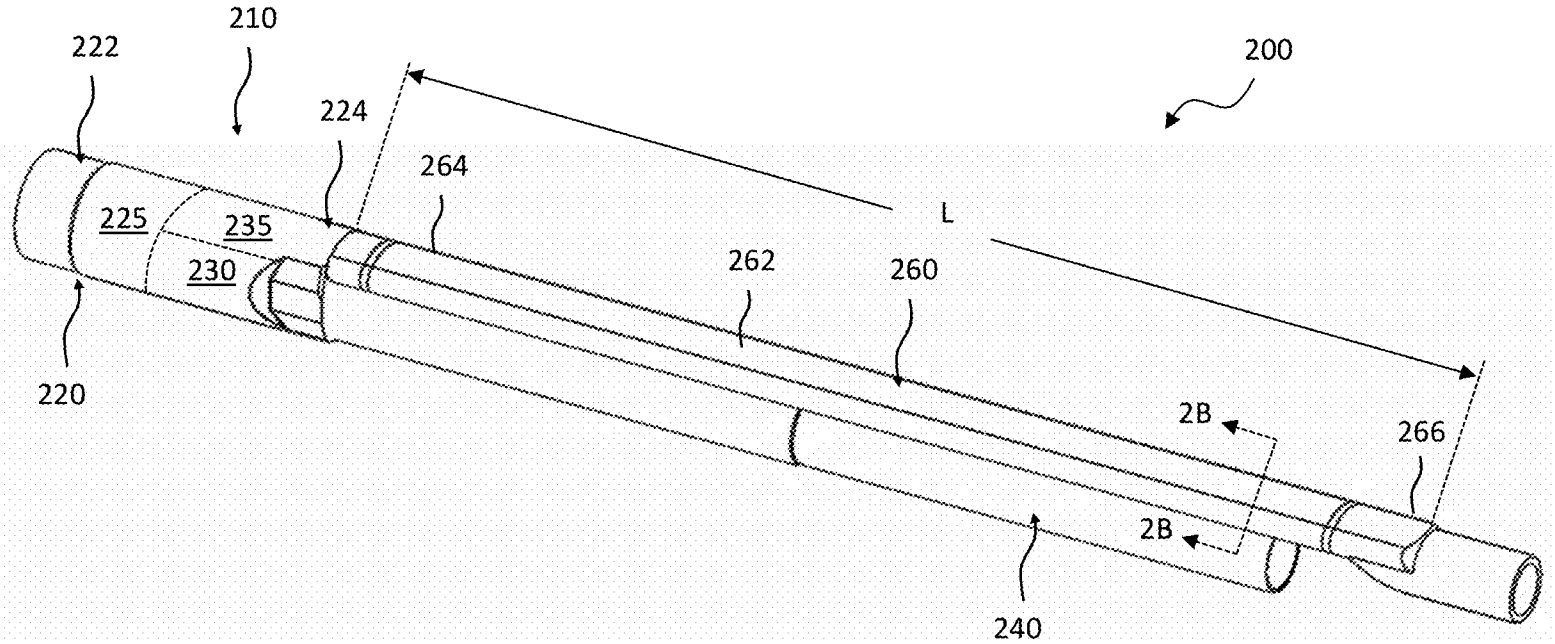

Turning to FIG. 2A illustrated is a perspective view of a multilateral junction 200 designed, manufactured and operated according to one or more embodiments of the disclosure. The multilateral junction 200, in the illustrated embodiment, includes without limitation a y-block 210, a mainbore leg 240, and a lateral bore leg 260.

The y-block 210 may include a housing 220. For example, the housing 220 could be a solid piece of metal having been milled to contain various different bores according to the disclosure. In another embodiment, the housing 220 is a cast metal housing formed with the various different bores according to the disclosure. The housing 220, in accordance with one embodiment, may include a first end 222 and a second opposing end 224. The first end 222, in one or more embodiments, is a first uphole end, and the second end 224, in one or more embodiments, is a second downhole end.

The y-block 210, in one or more embodiments, includes a single first bore 225 extending into the housing 220 from the first end 222. The y-block 210, in one or more embodiments, further includes a second bore 230 and a third bore 235 extending into the housing 220. In the illustrated embodiment the second bore 230 and the third bore 235 branch off from the single first bore 225 at a point between the first end 222 and the second opposing end 224. In accordance with one embodiment of the disclosure, the second bore 230 defines a second centerline and the third bore 235 defines a third centerline. The second centerline and the third centerline may have various different configurations relative to one another. In one embodiment the second centerline and the third centerline are parallel with one another. In another embodiment, the second centerline and the third centerline are angled relative to one another, and for example relative to the first centerline.

The lateral bore leg 260, in the illustrated embodiment, includes a unitary housing 262. The unitary housing 262, in the illustrated embodiment, has a first end 264 and a second opposing end 266 defining a length (L). The length (L) of the lateral bore leg 260 may vary greatly and remain within the scope of the disclosure.

Figure 2B:
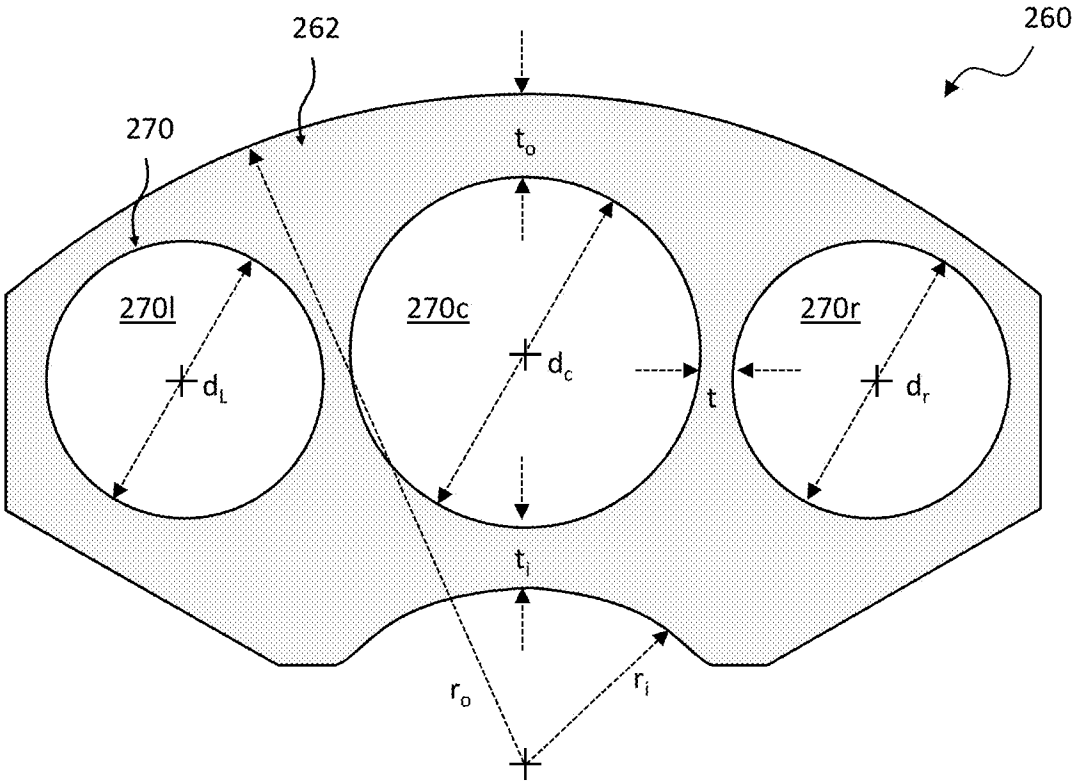

Turning to FIG. 2B with continued reference to FIG. 2A, illustrated is a cross-sectional view of the lateral bore leg 260 (e.g., multilateral bore leg) taken through the line 2B-2B of FIG. 2A. The lateral bore leg 260, in the illustrated embodiment, includes the unitary housing 262. Located within the unitary housing 262, in the illustrated embodiment, are three or more bores 270, the three or more bores 270 formed in the unitary housing 262 and extending along the length (L). In the illustrated embodiment of FIG. 2B, the lateral bore leg 260 includes a center bore 270*c*, a right bore 270*r*, and a left bore 270*l*. In the illustrated embodiment, a centerpoint of each of the center bore 270*c*, right bore 270*r* and left bore 270*l* are laterally offset from one another. Further to this embodiment, the centerpoint of the center bore 270*c* is horizontally offset from the right bore 270*r* and the left bore 270*l*. In the embodiment of FIG. 2B, the center bore 270*c*, right bore 270*r* and left bore 270*l* do not overlap one another, and thus provide three separate flow paths and three separate tool paths.

Further to the embodiment of FIG. 2B, the center bore 270*c* has a diameter ($d_c$), the right bore 270*r* has a diameter ($d_r$), and the left bore 270*l* has a diameter ($d_l$). While not specifically required, in the embodiment of FIG. 2B, the diameter ($d_c$) is greater than the diameters ($d_r$) and ($d_l$). Other embodiments exist wherein the diameter ($d_c$) is not greater than the diameters ($d_r$) and ($d_l$), or alternatively wherein the diameter ($d_c$) is less than the diameters ($d_r$) and ($d_l$).

In certain embodiments, such as that illustrated in FIG. 2B, the unitary housing 262 is generally D-shaped, thereby having one somewhat straight surface and an opposing curved surface. The unitary housing 262 illustrated in FIG. 2B has an inner radial profile ($r_i$) and an outer radial profile ($r_o$). In at least one embodiment, the outer radial profile ($r_o$) is operable to mimic an outer radial profile of the y-block 210. The outer radial profile ($r_o$) may range greatly, but in one or more embodiments the outer radial profile ($r_o$) ranges from about 2.5 cm to about 30 cm (e.g., from about 1 inches to about 12 inches). The outer radial profile ($r_o$), in one or more embodiments, ranges from about 3.8 cm to about 20.3 cm (e.g., from about 1.5 inches to about 8 inches). In yet another embodiment, the outer radial profile ($r_o$) may range from about 7.6 cm to about 15.3 cm (e.g., from about 3 inches to about 6 inches). In yet another embodiment, the outer radial profile ($r_o$) may range from about 8.9 cm to about 12.7 cm (e.g., from about 3.5 inches to about 5 inches), and more specifically in one embodiment a value of about 11.4 cm (e.g., about 4.5 inches). Furthermore, in at least one embodiment, the inner radial profile ($r_i$) is operable to hug a radius of a mainbore leg 240 as the pair are being deployed. Accordingly, the inner radial profile ($r_i$) would have similar values as an outer radius of the mainbore leg 240.

The unitary housing 262 may additionally have an inner thickness ($t_i$), for example where the center bore 270*c* approaches the inner radial profile ($r_i$). The unitary housing may additionally have an outer thickness ($t_o$), for example where the center bore 270*c* approaches the outer radial profile ($r_o$). In designing the lateral bore leg 260, the diameter ($d_c$) of the center bore 270*c* may be maximized such that an acceptable inner thickness ($t_i$) and outer thickness ($t_o$) are achieved, and that the lateral bore leg 260 can handle the necessary stresses placed thereon. Similarly, a wall thickness (t) may exist between the center bore 270*c* and the right and left bores 270*r*, 270*l*. In designing the lateral bore leg 260, the diameter ($d_c$) of the center bore 270*c* may be maximized such that an acceptable wall thickness (t) is achieved, and that the lateral bore leg 260 can handle the necessary stresses placed thereon.

Figure 2C:
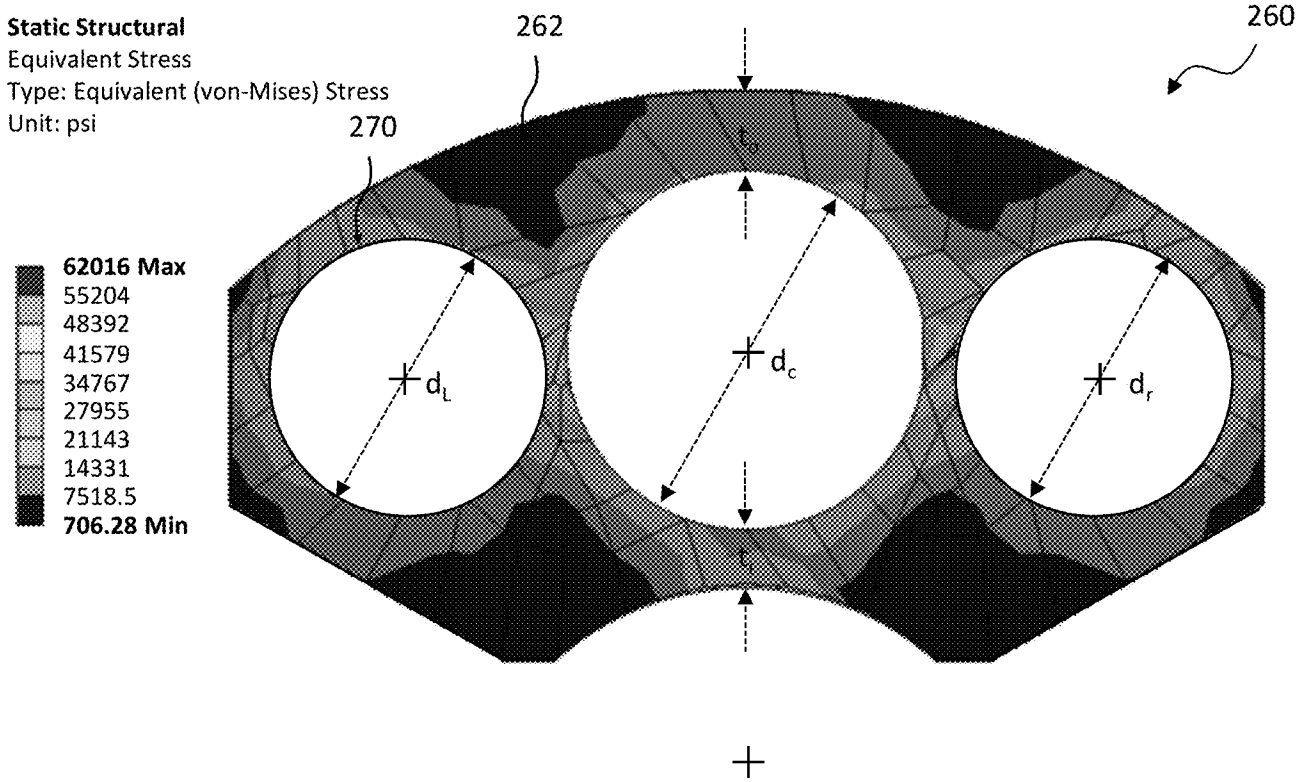

Turning to FIG. 2C, illustrated is a stress map of the lateral bore leg 260 illustrated in FIG. 2B. Note, in the embodiment of FIG. 2C, the highest stresses are experienced proximate the wall thickness (t). Accordingly, the lateral bore leg 260 has maximized the flow area, while at the same time keeping the stresses to acceptable values.

The lateral bore leg 260, in one or more embodiments, is a high pressure lateral bore leg. For example, in at least one embodiment, the lateral bore leg 260 is capable of withstanding at least 5,000 psi burst rate. In yet another example, the lateral bore leg 2600 is capable of withstanding at least 10,000 psi burst rate. In at least one embodiment, the lateral bore leg 260 is capable of withstanding at least 4,000 psi collapse rate. In yet another example, the lateral bore leg 260 is capable of withstanding at least 7000 psi collapse rate. Accordingly, the lateral bore leg 260 may be employed to access and fracture one or both of the main wellbore and/or lateral wellbore. For example, the lateral bore leg 260 could have the necessary pressure ratings, outside diameters, and inside diameters necessary to run a fracturing string there through, and thereafter appropriately and safely fracture one or both of the main wellbore and/or lateral wellbore. Moreover, the lateral bore leg 260 would ideally have a yield strength of at least 80 ksi, so as to meet the NACE standard.

Figure 3:
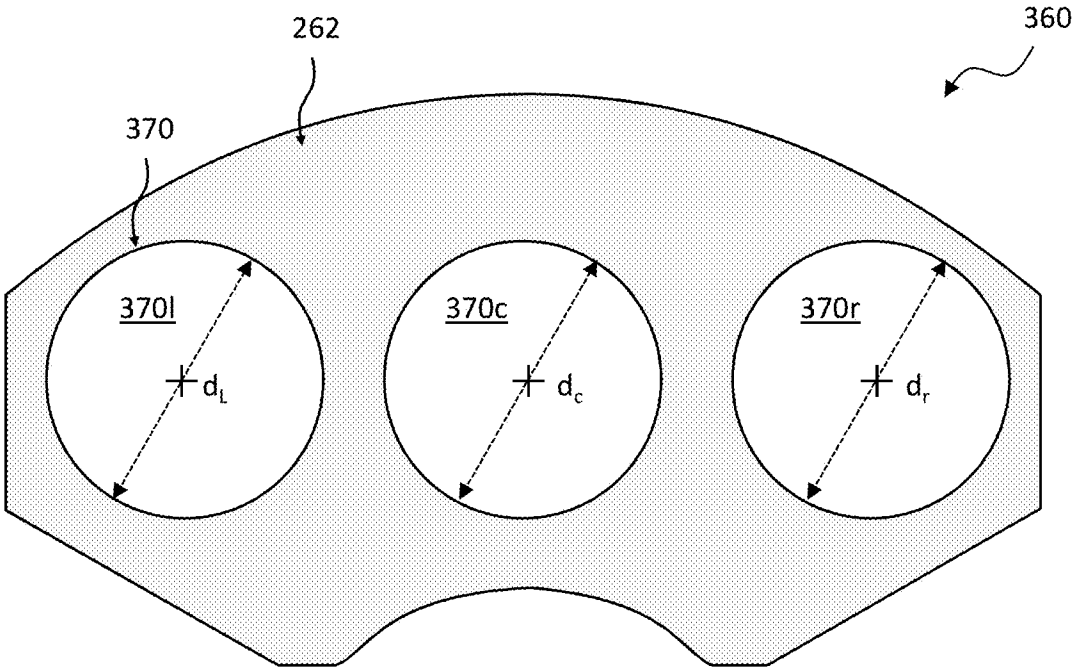
FIG. 3 illustrates a cross-sectional view of an alternative embodiment of lateral bore leg according to one or more embodiments of the disclosure.

Turning to FIG. 3, illustrated is a cross-sectional view of an alternative embodiment of lateral bore leg 360. The lateral bore leg 360 of FIG. 3 is similar in many respects to the lateral bore leg 260 illustrated in FIG. 2B. Accordingly, like reference numbers have been used to illustrate similar, if not identical, features. The lateral bore leg 360 differs for the most part from the lateral bore leg 260, in that a centerpoint of each of the center bore 370*c*, right bore 370*r* and left bore 370*l* are laterally offset from one another, and the centerpoint of the center bore 370*c*, right bore 370*r* and left bore 370*l* are horizontally aligned with each other. Further to the embodiment of FIG. 3, the diameter ($d_c$), diameter ($d_r$), and diameter ($d_l$) equal each other.

Figure 4:
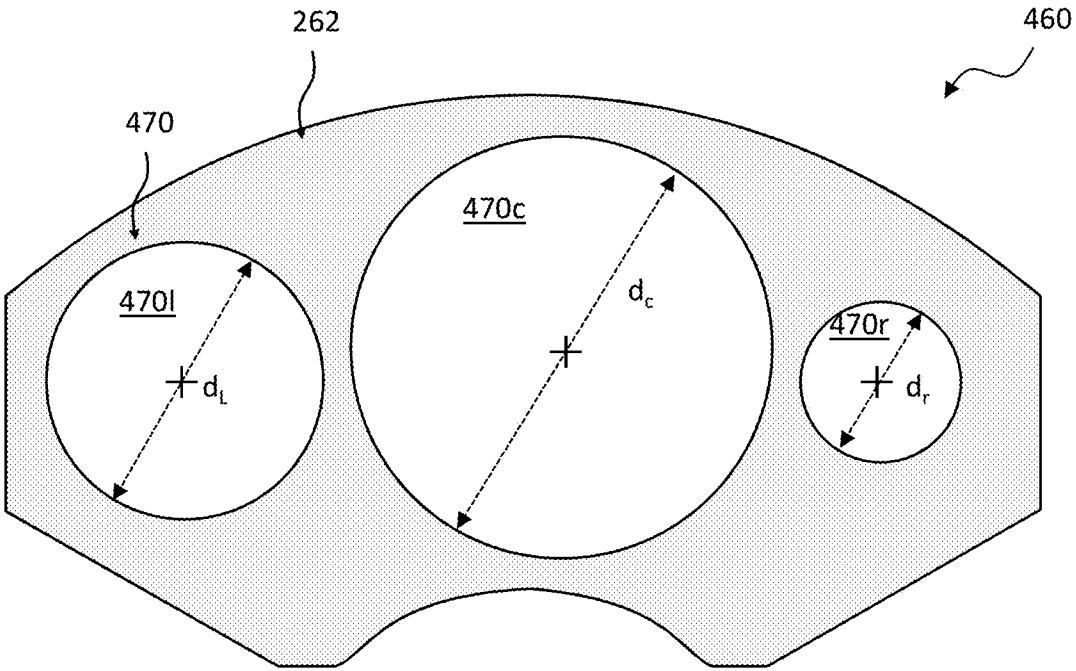
FIG. 4 illustrates a cross-sectional view of an alternative embodiment of lateral bore leg according to one or more embodiments of the disclosure.

Turning to FIG. 4, illustrated is a cross-sectional view of an alternative embodiment of lateral bore leg 460. The lateral bore leg 460 of FIG. 4 is similar in many respects to the lateral bore leg 260 illustrated in FIG. 2B. Accordingly, like reference numbers have been used to illustrate similar, if not identical, features. The lateral bore leg 460 differs for the most part from the lateral bore leg 260, in that the diameter ($d_c$), the diameter ($d_r$) and the diameter ($d_l$) differ from each other, and furthermore the diameter ($d_c$) is the largest diameter.

Figure 5:
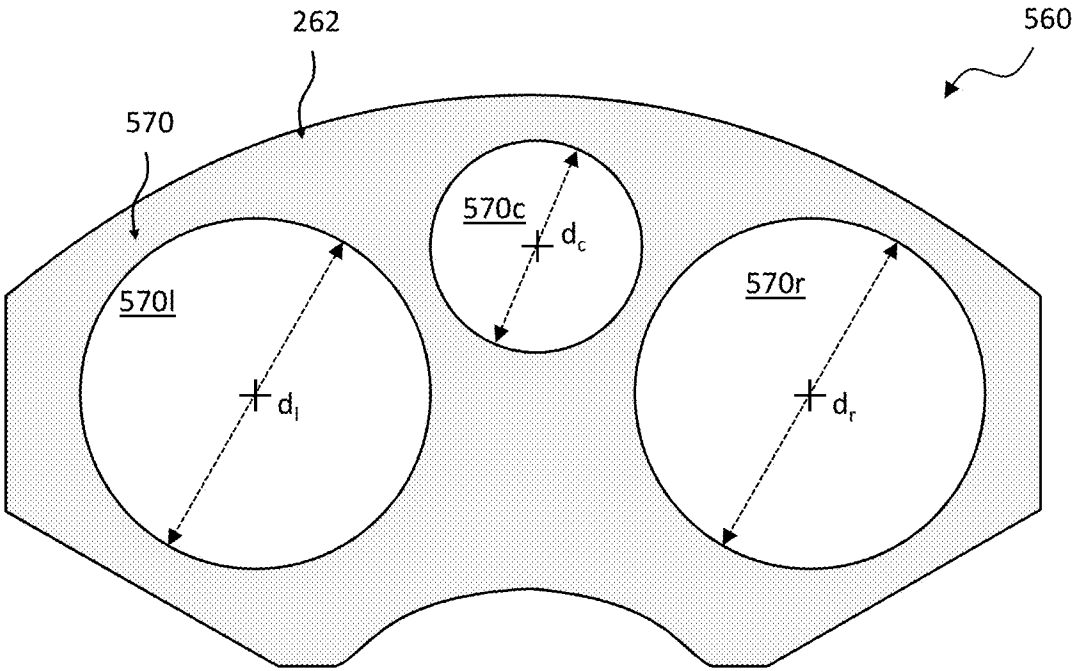
FIG. 5 illustrates a cross-sectional view of an alternative embodiment of lateral bore leg according to one or more embodiments of the disclosure.

Turning to FIG. 5, illustrated is a cross-sectional view of an alternative embodiment of lateral bore leg 560. The lateral bore leg 560 of FIG. 5 is similar in many respects to the lateral bore leg 260 illustrated in FIG. 2B. Accordingly, like reference numbers have been used to illustrate similar, if not identical, features. The lateral bore leg 560 differs for the most part from the lateral bore leg 260, in that the diameter ($d_c$) is the smallest diameter, and furthermore the diameter ($d_r$) and diameter ($d_l$) equal each other.

Figure 6A:
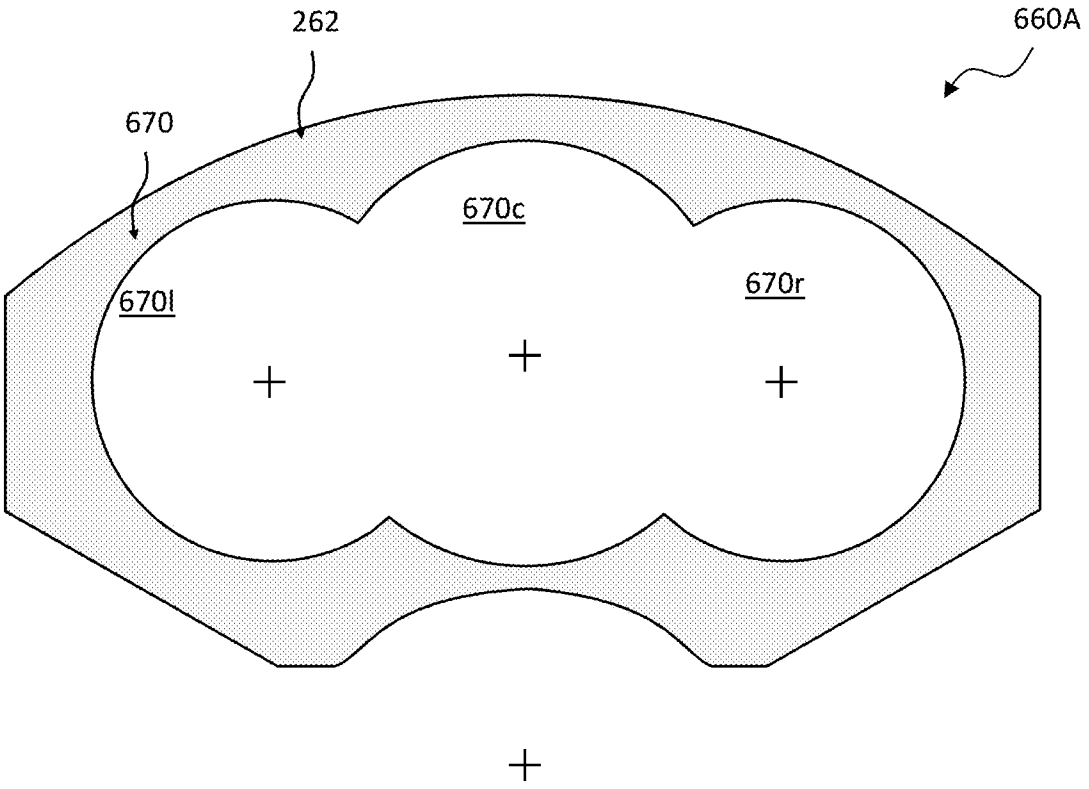
FIG. 6A illustrates a cross-sectional view of an alternative embodiment of lateral bore leg according to one or more embodiments of the disclosure.

Turning to FIG. 6A, illustrated is a cross-sectional view of an alternative embodiment of lateral bore leg 660A. The lateral bore leg 660A of FIG. 6A is similar in many respects to the lateral bore leg 260 illustrated in FIG. 2B. Accordingly, like reference numbers have been used to illustrate similar, if not identical, features. The lateral bore leg 660A differs for the most part from the lateral bore leg 260, in that the center bore 670*c*, right bore 670*r* and left bore 670*l* overlap one another to provide a single combined flow path but three separate tool paths.

Figure 6B:
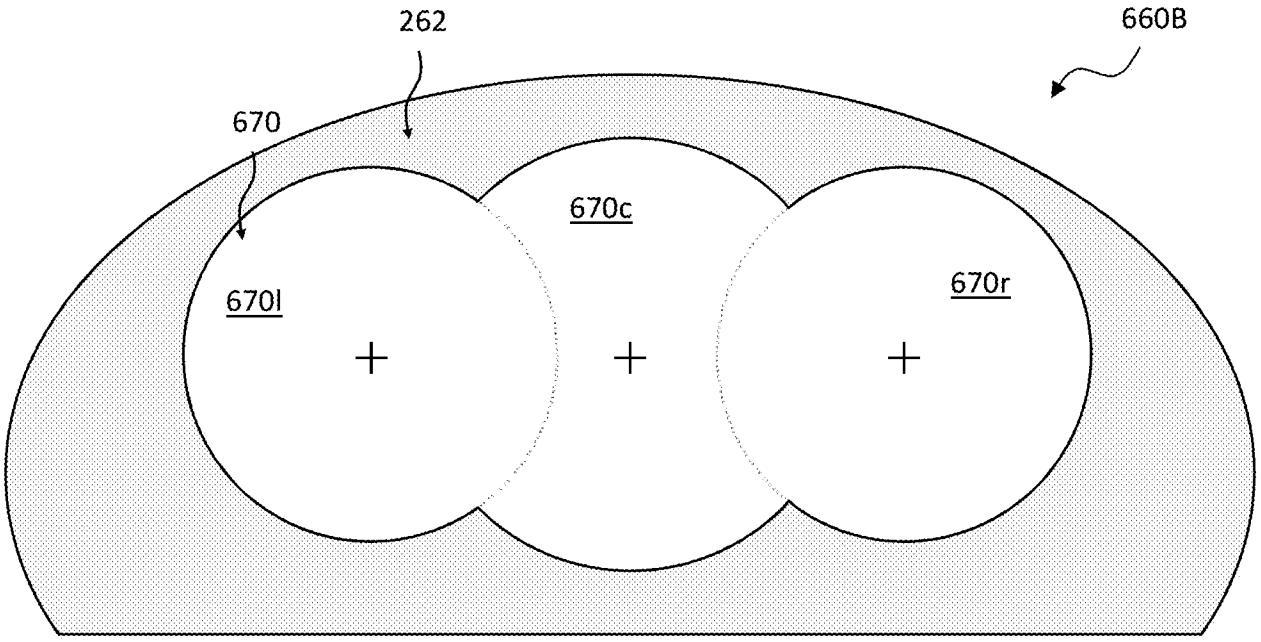
FIG. 6B illustrates a cross-sectional view of an alternative embodiment of lateral bore leg according to one or more embodiments of the disclosure.

Turning to FIG. 6B, illustrated is a cross-sectional view of an alternative embodiment of lateral bore leg 660B. The lateral bore leg 660B of FIG. 6B is similar in many respects to the lateral bore leg 660A illustrated in FIG. 6A. Accordingly, like reference numbers have been used to illustrate similar, if not identical, features. The lateral bore leg 660B of FIG. 6B differs for the most part from the lateral bore leg 660A of FIG. 6A, in that the unitary housing 262 does not include the inner radial profile ($r_i$). Accordingly, the unitary housing 262 of FIG. 6B closer to a D-shape than the unitary housing 262 of FIG. 6A.

Figure 7:
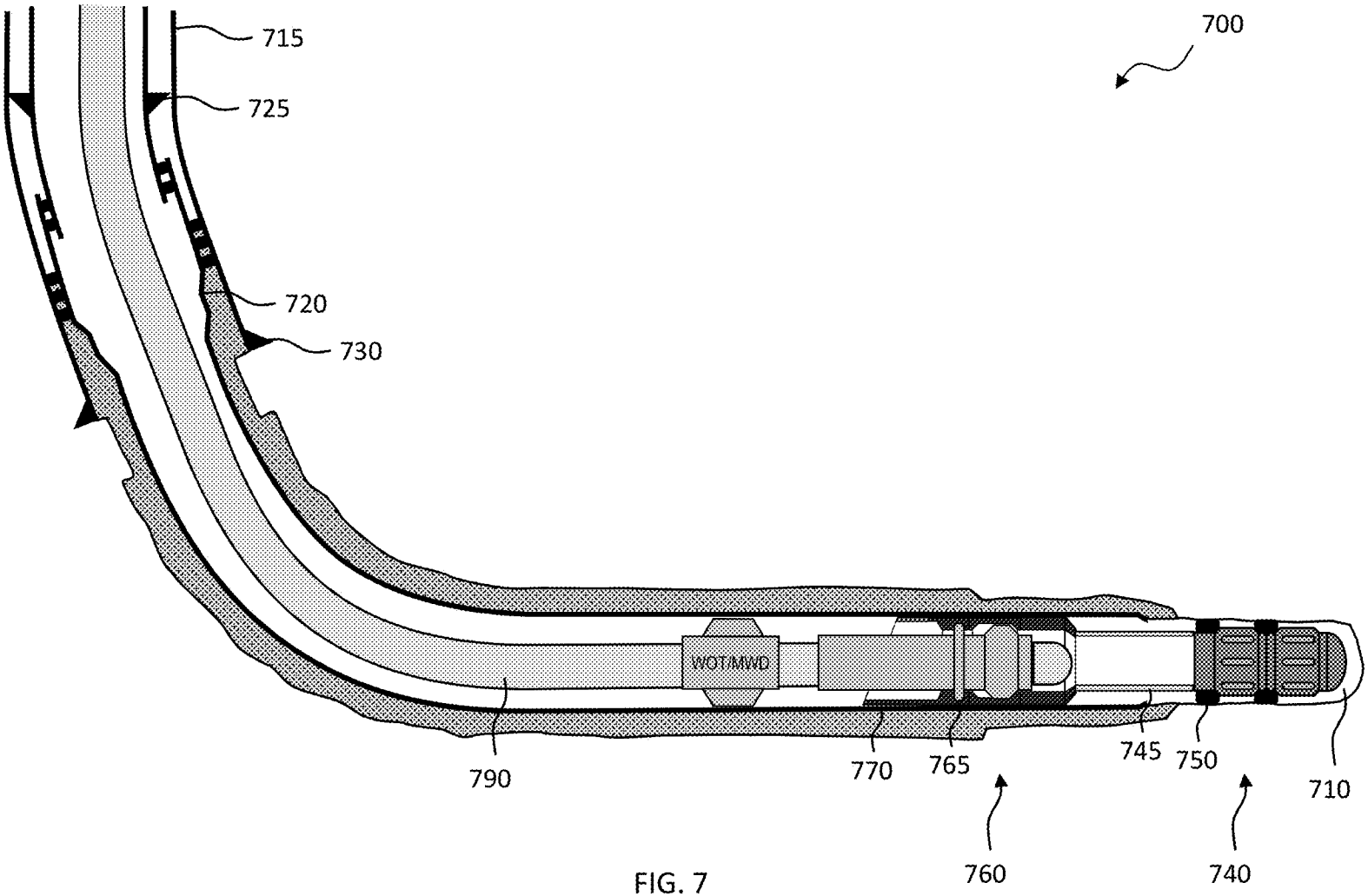
FIGS. 7 through 19 illustrate a method for forming, fracturing and/or producing from a well system.

Turning now to FIGS. 7 through 19, illustrated is a method for forming, intervening, fracturing and/or producing from a well system 700. FIG. 7 is a schematic of the well system 700 at the initial stages of formation. A main wellbore 710 may be drilled, for example by a rotary steerable system at the end of a drill string and may extend from a well origin (not shown), such as the earth's surface or a sea bottom. The main wellbore 710 may be lined by one or more casings 715, 720, each of which may be terminated by a shoe 725, 730.

The well system 700 of FIG. 7 additionally includes a main wellbore completion 740 positioned in the main wellbore 710. The main wellbore completion 740 may, in certain embodiments, include a main wellbore liner 745 (e.g., with frac sleeves in one embodiment), as well as one or more packers 750 (e.g., swell packers in one embodiment). The main wellbore liner 745 and the one or more packer 750 may, in certain embodiments, be run on an anchor system 760. The anchor system 760, in one embodiment, includes a collet profile 765 for engaging with the running tool 790, as well as a muleshoe 770 (e.g., slotted alignment muleshoe). A standard workstring orientation tool (WOT) and measurement while drilling (MWD) tool may be coupled to the running tool 790, and thus be used to orient the anchor system 760.

Figure 8:
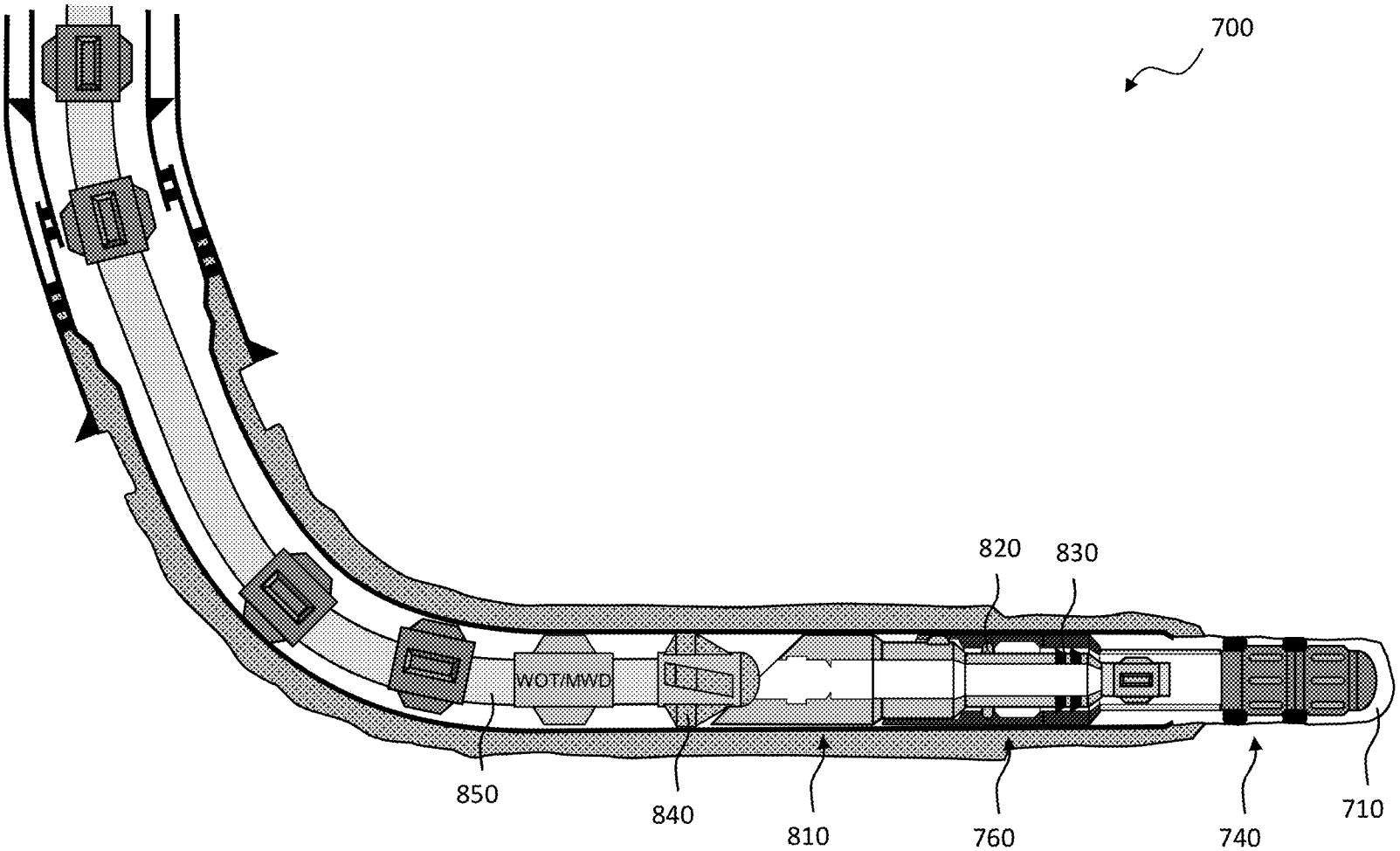

Turning to FIG. 8, illustrated is the well system 700 of FIG. 7 after positioning a whipstock assembly 810 downhole at a location where a lateral wellbore is to be formed. The whipstock assembly 810 includes a collet 820 for engaging the collet profile 765 in the anchor system 760. The whipstock assembly 810 additionally includes one or more seals 830 (e.g., a wiper set in one embodiment) to seal the whipstock assembly 810 with the main wellbore completion 740. In certain embodiments, such as that shown in FIG. 8, the whipstock assembly 810 is made up with a lead mill 840, for example using a shear bolt, and then run in hole on a drill string 850. The WOT/MWD tool may be employed to confirm the appropriate orientation of the whipstock assembly 810.

Figure 9:
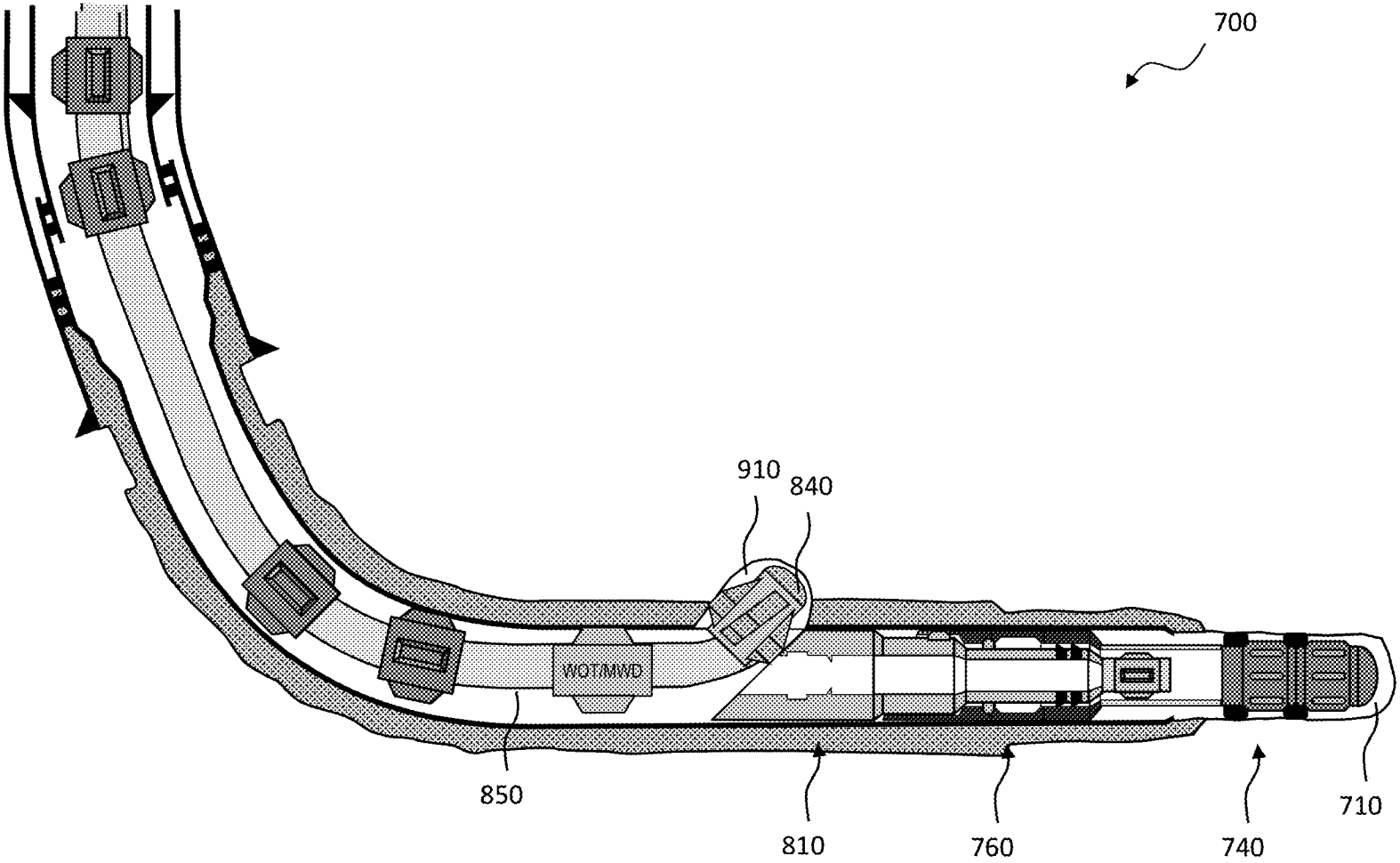

Turning to FIG. 9, illustrated is the well system 700 of FIG. 8 after setting down weight to shear the shear bolt between the lead mill 840 and the whipstock assembly 810, and then milling an initial window pocket 910. In certain embodiments, the initial window pocket 910 is between 1.5 m and 3.0 m long, and in certain other embodiments about 2.5 m long, and extends through the casing 720. Thereafter, a circulate and clean process could occur, and then the drill string 850 and lead mill 840 may be pulled out of hole.

Figure 10:
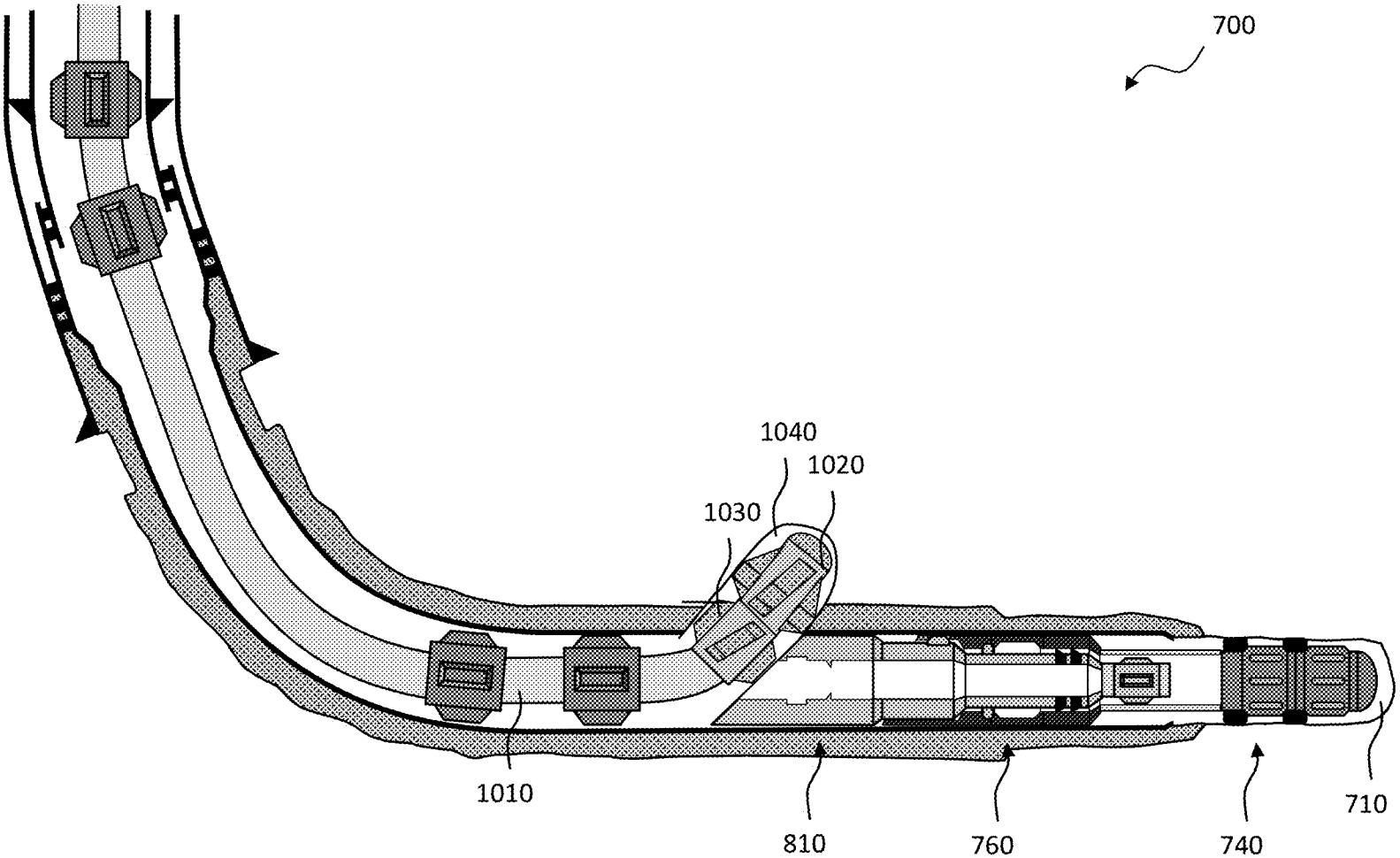

Turning to FIG. 10, illustrated is the well system 700 of FIG. 9 after running a lead mill 1020 and watermelon mill 1030 downhole on a drill string 1010. In the embodiments shown in FIG. 10, the drill string 1010, lead mill 1020 and watermelon mill 1030 drill a full window pocket 1040 in the formation. In certain embodiments, the full window pocket 1040 is between 6 m and 10 m long, and in certain other embodiments about 8.5 m long. Thereafter, a circulate and clean process could occur, and then the drill string 1010, lead mill 1020 and watermelon mill 1030 may be pulled out of hole.

Figure 11:
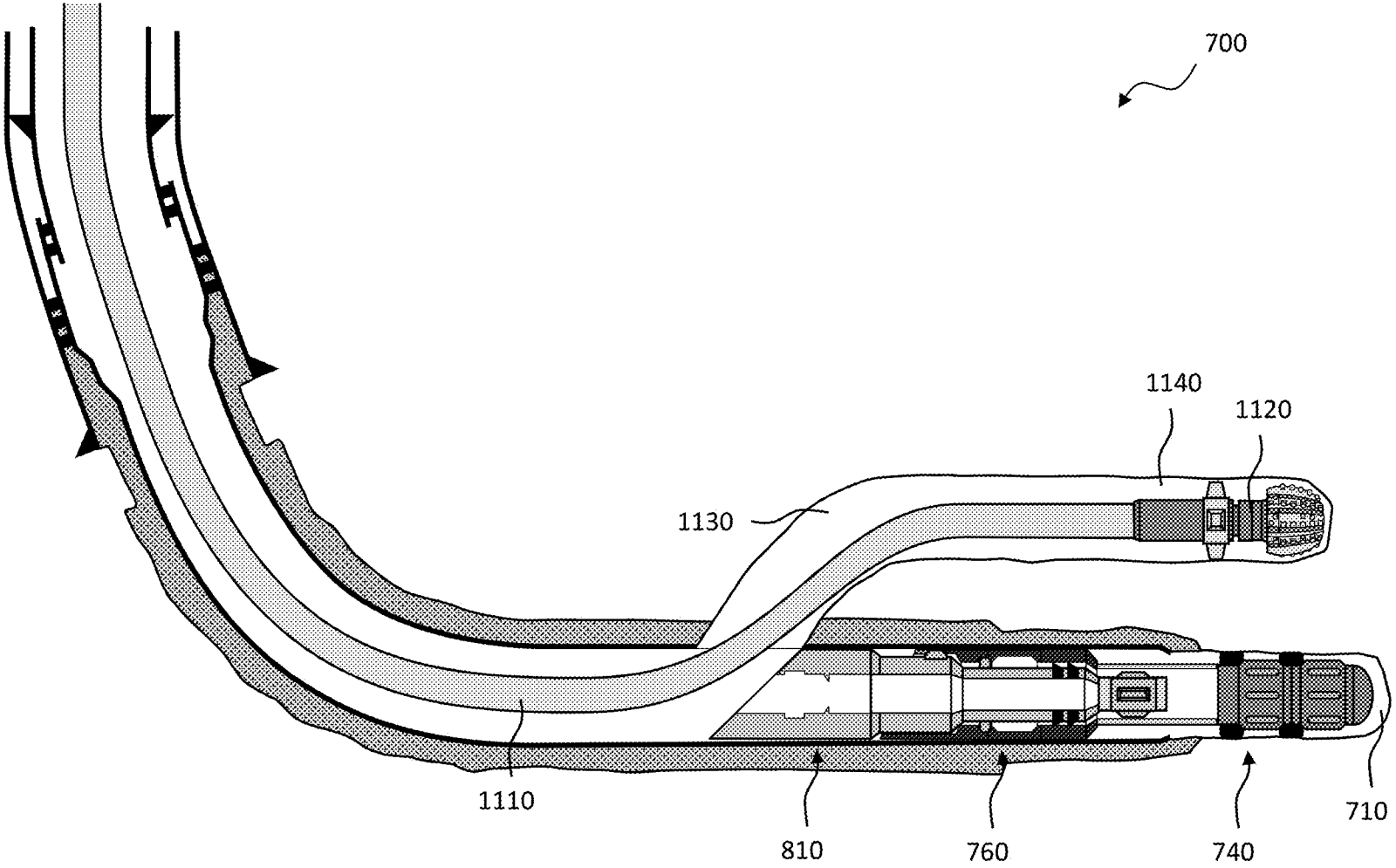

Turning to FIG. 11, illustrated is the well system 700 of FIG. 10 after running in hole a drill string 1110 with a rotary steerable assembly 1120, drilling a tangent 1130 following an inclination of the whipstock assembly 810, and then continuing to drill the lateral wellbore 1140 to depth. Thereafter, the drill string 1110 and rotary steerable assembly 1120 may be pulled out of hole.

Figure 12:
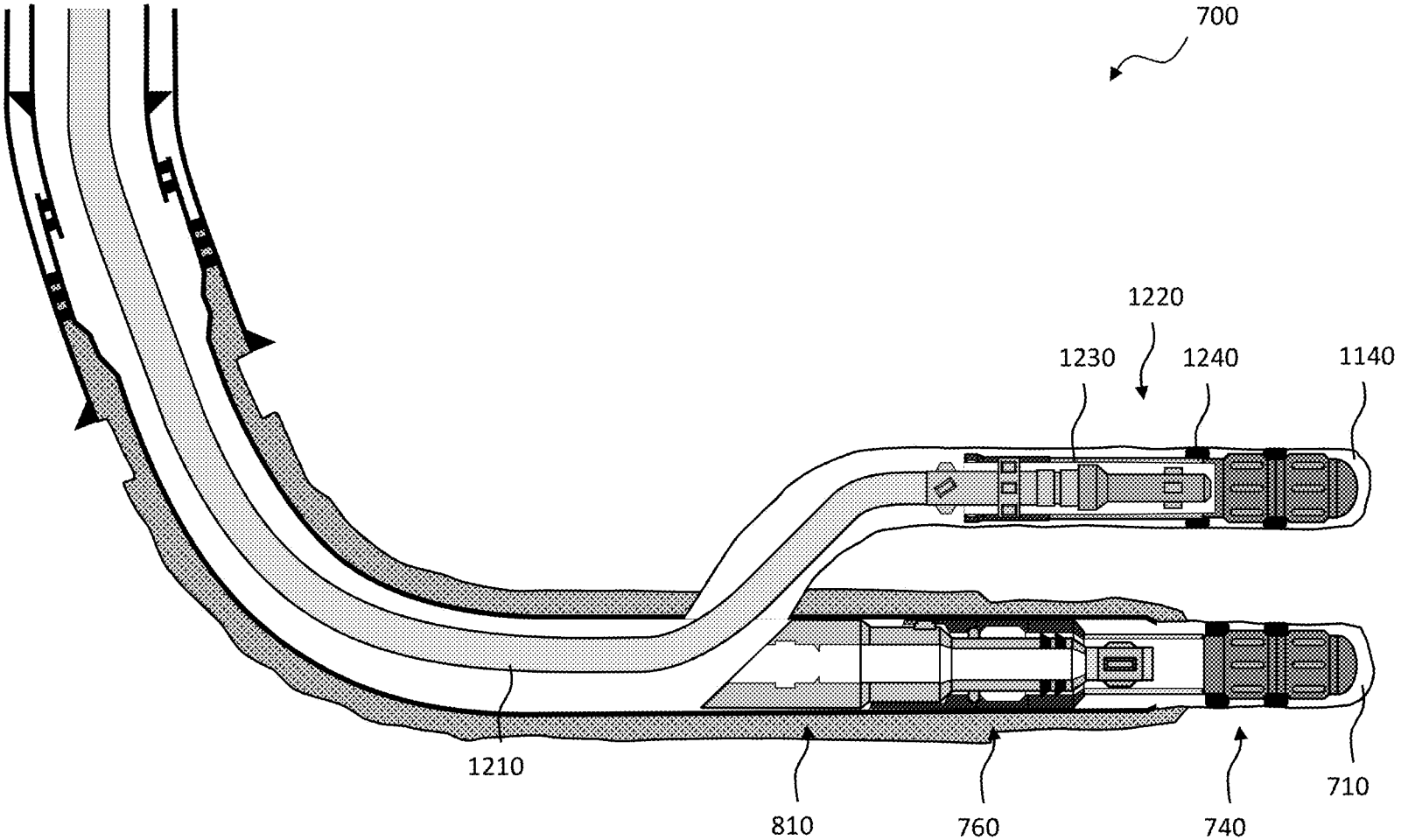

Turning to FIG. 12, illustrated is the well system 700 of FIG. 11 after employing an inner string 1210 to position a lateral wellbore completion 1220 in the lateral wellbore 1140. The lateral wellbore completion 1220 may, in certain embodiments, include a lateral wellbore liner 1230 (e.g., with frac sleeves in one embodiment), as well as one or more packers 1240 (e.g., swell packers in one embodiment). Thereafter, the inner string 1210 may be pulled into the main wellbore 710 for retrieval of the whipstock assembly 810.

Figure 13:
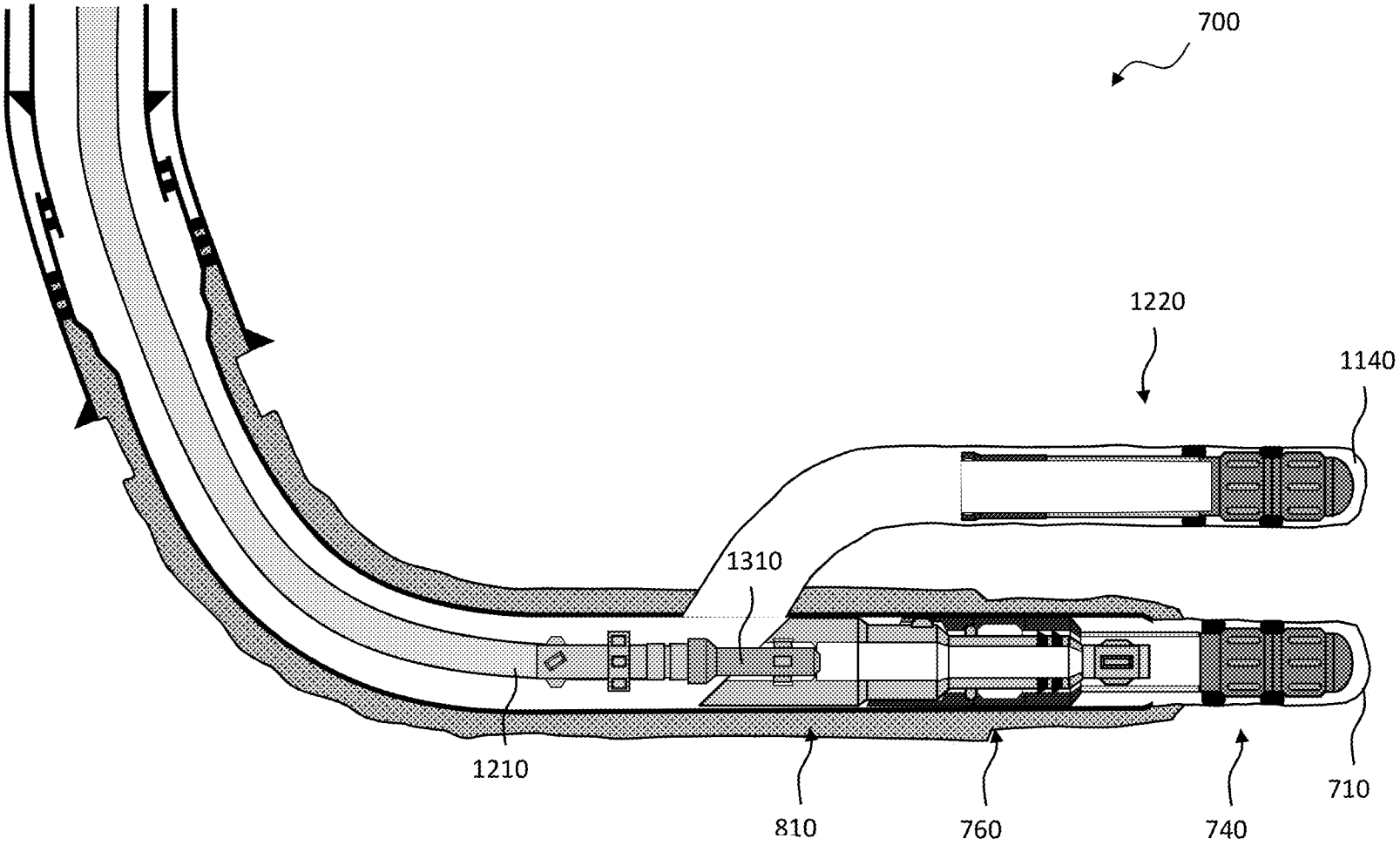

Turning to FIG. 13, illustrated is the well system 700 of FIG. 12 after latching a whipstock retrieval tool 1310 of the inner string 1210 with a profile in the whipstock assembly 810. The whipstock assembly 810 may then be pulled free from the anchor system 760, and then pulled out of hole. What results are the main wellbore completion 740 in the main wellbore 710, and the lateral wellbore completion 1220 in the lateral wellbore 1140.

Figure 14:
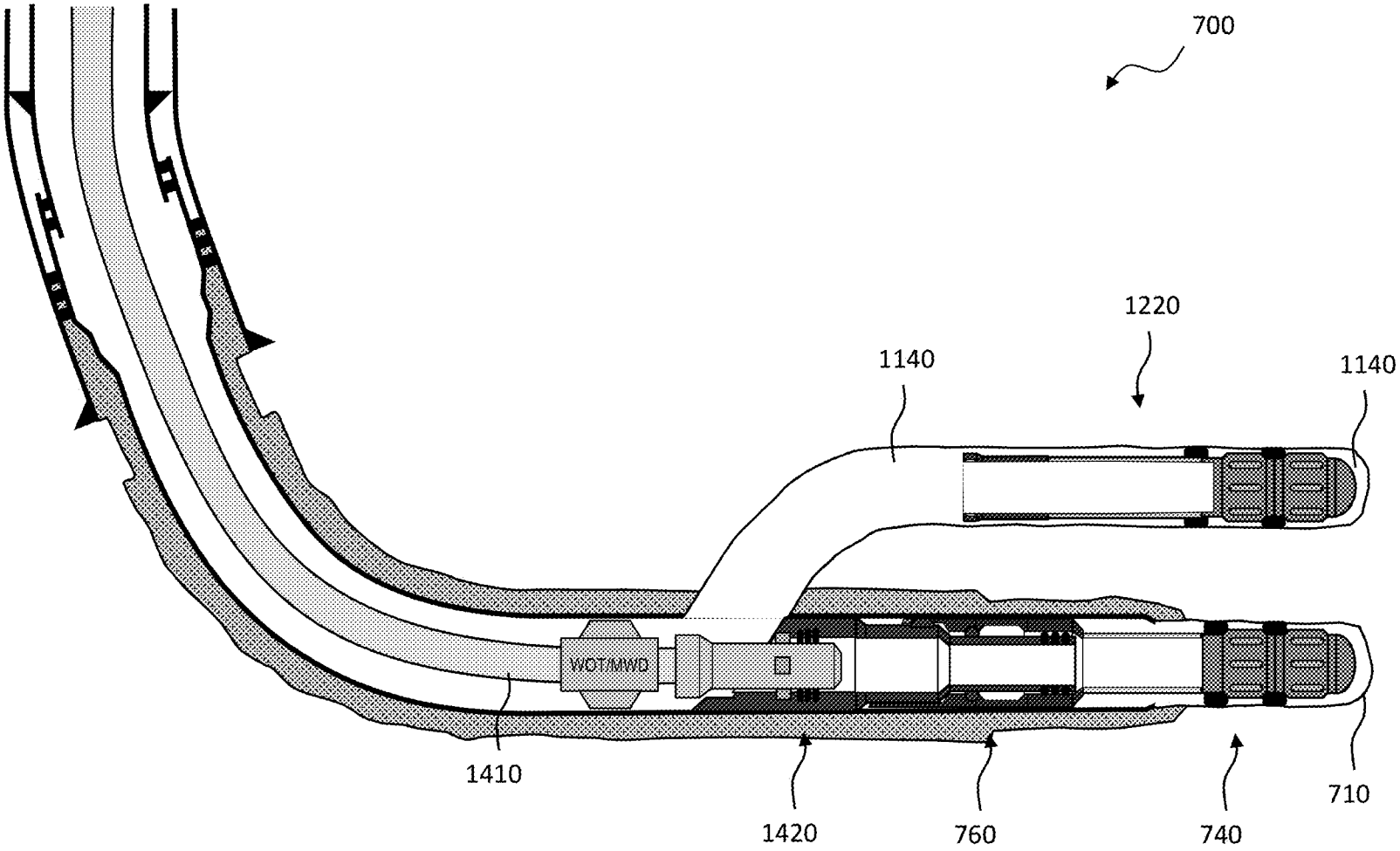

Turning to FIG. 14, illustrated is the well system 700 of FIG. 13 after employing a running tool 1410 to install a deflector assembly 1420 proximate a junction between the main wellbore 710 and the lateral wellbore 1140. The deflector assembly 1420 may be appropriately oriented using the WOT/MWD tool. The running tool 1410 may then be pulled out of hole.

Figure 15:
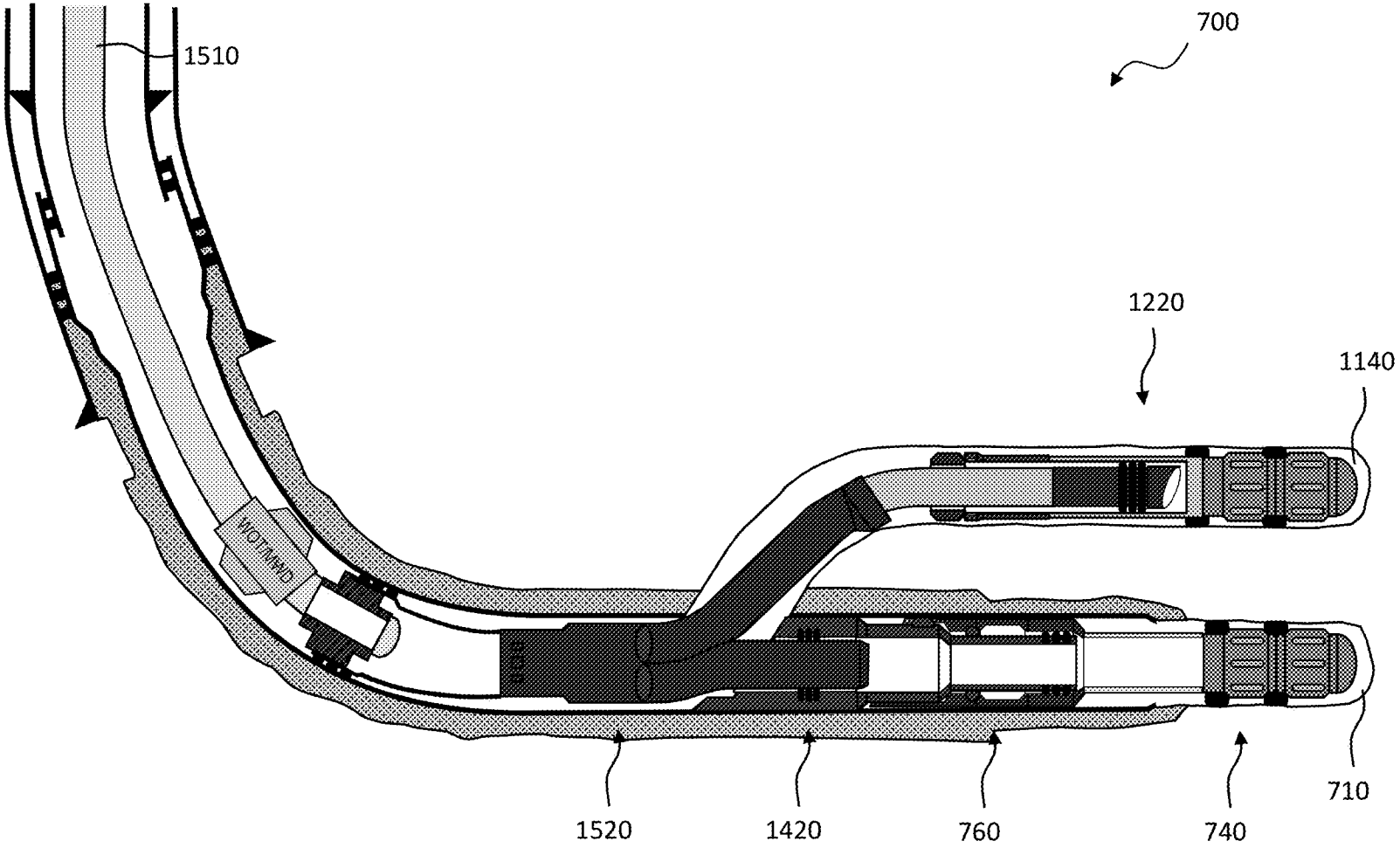

Turning to FIG. 15, illustrated is the well system 700 of FIG. 14 after employing a running tool 1510 to place a multilateral junction 1520 proximate an intersection between the main wellbore 710 and the lateral wellbore 1410. In accordance with one embodiment, the multilateral junction 1520 could be similar to one or more of the multilateral junctions discussed above with respect to FIGS. 2 through 6. Accordingly, while not clearly illustrated in the embodiment of FIG. 15 as result of the scale of the drawings, the multilateral junction 1520 could have the aforementioned lateral well bore as discussed above.

Figure 16:
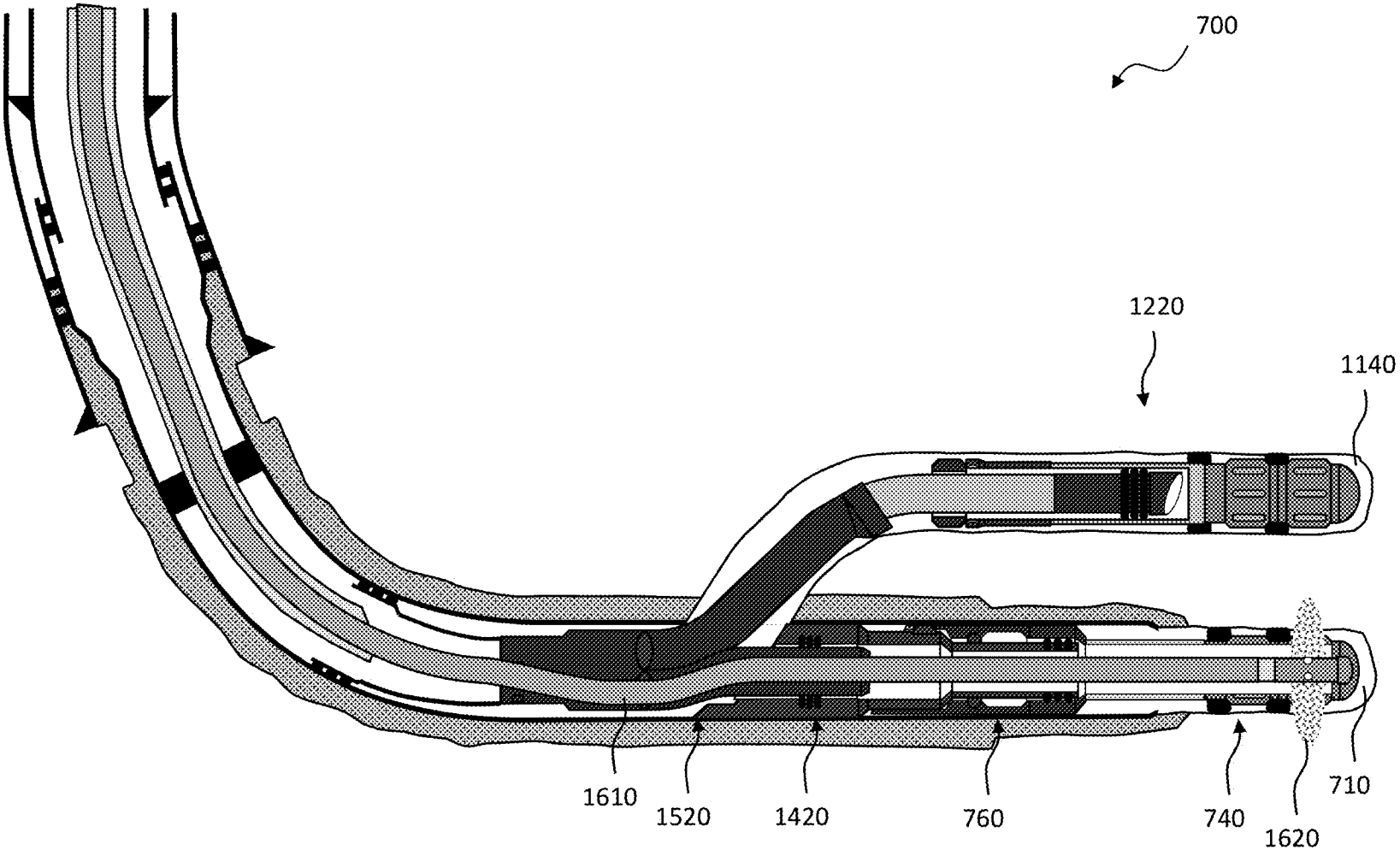

Turning to FIG. 16, illustrated is the well system 700 of FIG. 15 after selectively accessing the main wellbore 710 with a first intervention tool 1610 through the y-block of the multilateral junction 1520. In the illustrated embodiment, the first intervention tool 1610 is a fracturing tool, and more particularly a coiled tubing conveyed fracturing tool. With the first intervention tool 1610 in place, fractures 1620 in the subterranean formation surrounding the main wellbore completion 740 may be formed. Thereafter, the first intervention tool 1610 may be pulled from the main wellbore completion 740.

Figure 17:
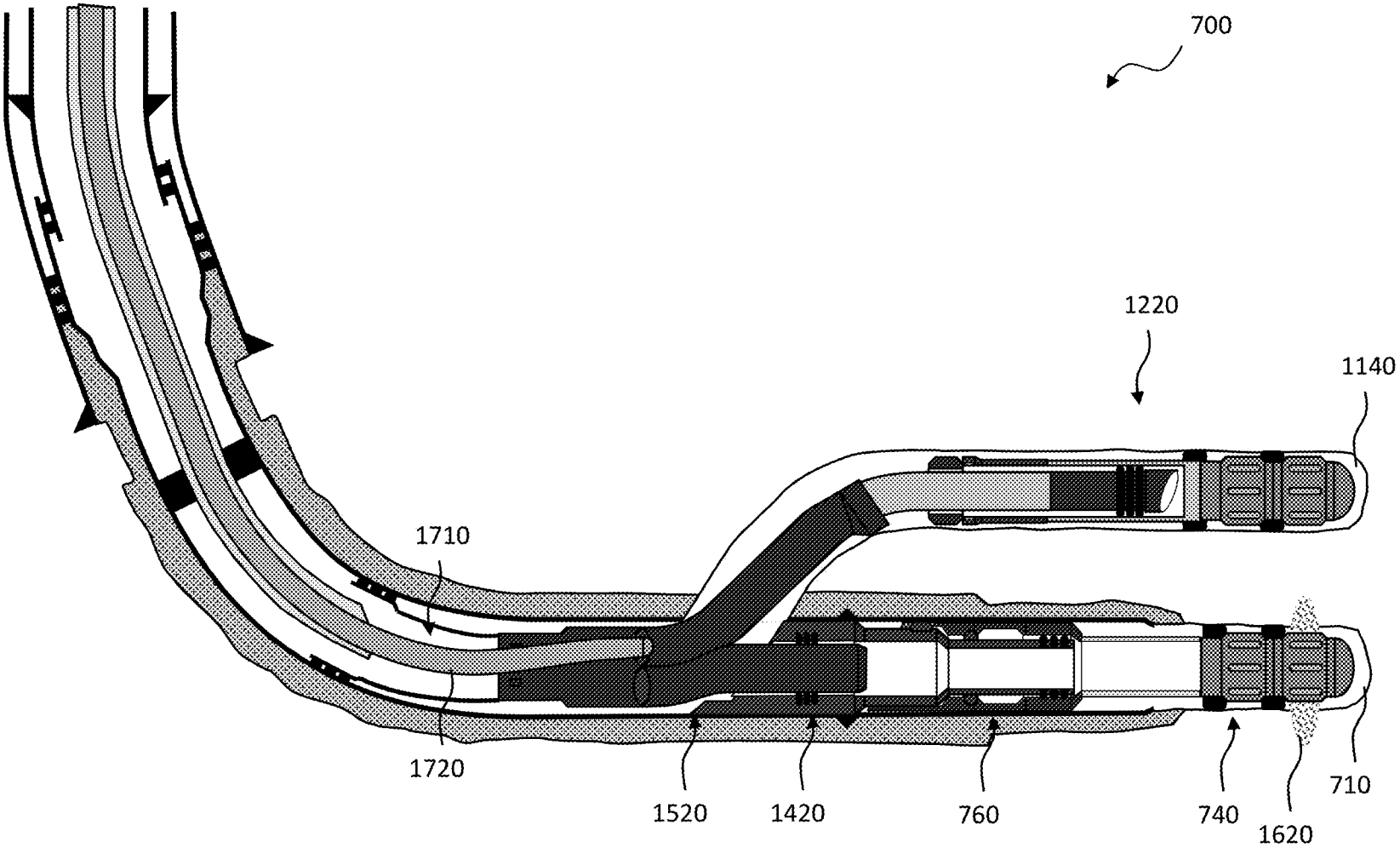

Turning to FIG. 17, illustrated is the well system 700 of FIG. 16 after positioning a downhole tool 1710 within the multilateral junction 1520 including the y-block. In the illustrated embodiment, the downhole tool 1710 is a fracturing tool, and more particularly a coiled tubing conveyed fracturing tool.

Figure 18:
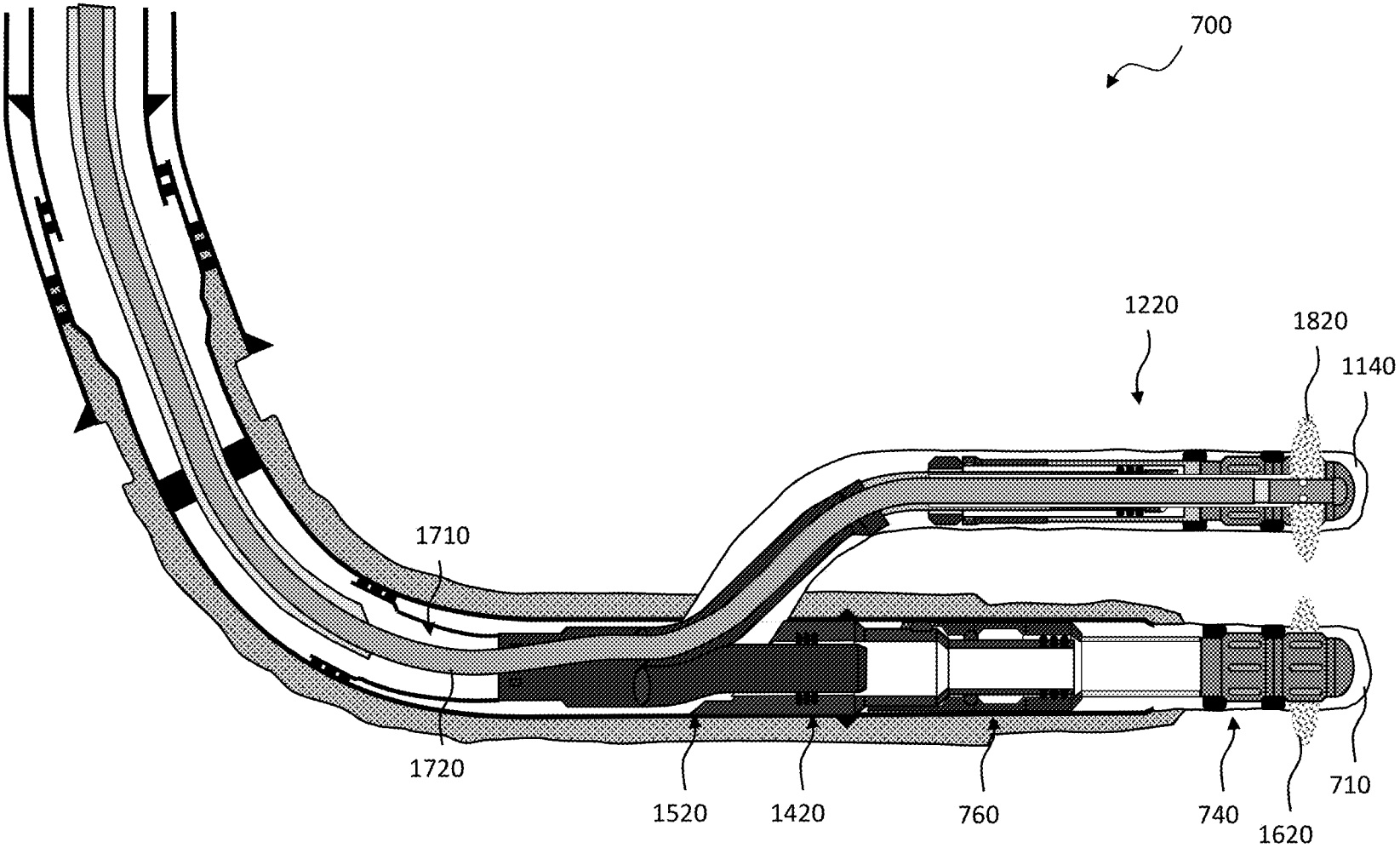

Turning to FIG. 18, illustrated is the well system 700 of FIG. 17 after putting additional weight down on the second intervention tool 1710 and causing the second intervention tool 1710 to enter the lateral wellbore 1140. With the downhole tool 1710 in place, fractures 1820 in the subterranean formation surrounding the lateral wellbore completion 1220 may be formed. In certain embodiments, the first intervention tool 1610 and the second intervention tool 1710 are the same intervention tool. Thereafter, the second intervention tool 1710 may be pulled from the lateral wellbore completion 1220 and out of the hole.

Figure 19:
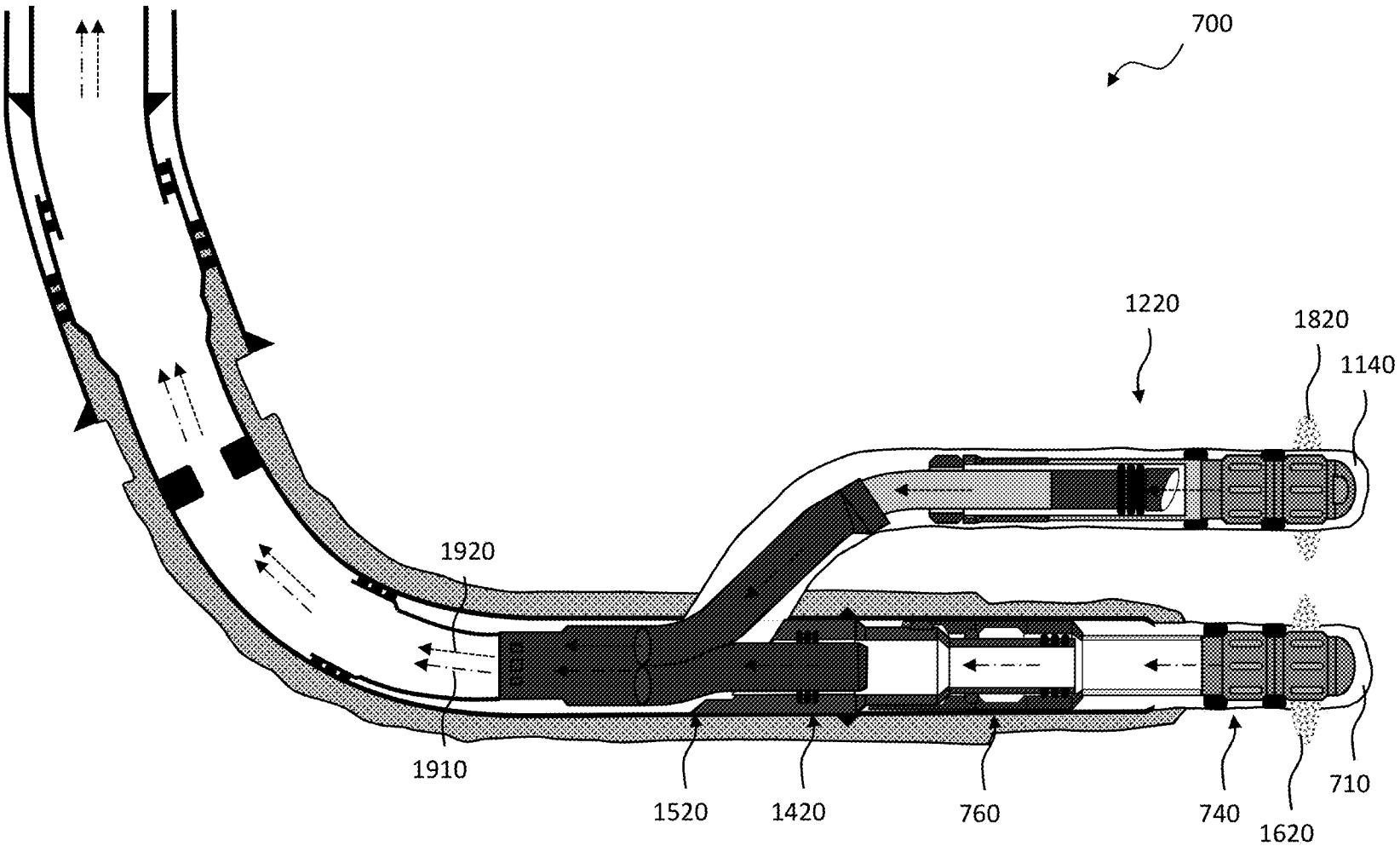

Turning to FIG. 19, illustrated is the well system 700 of FIG. 18 after producing fluids 1910 from the fractures 1620 in the main wellbore 710, and producing fluids 1920 from the fractures 1820 in the lateral wellbore 1140. The producing of the fluids 1910, 1920 occur through the multilateral junction 1520, and more specifically through the y-block design, manufactured and operated according to one or more embodiments of the disclosure.

Aspects Disclosed Herein Include:

A. A multilateral bore leg, the multilateral bore leg including: 1) a unitary housing having a first end and a second opposing end defining a length (L); and 2) three or more bores formed in the housing and extending along the length (L).

B. A multilateral junction, the multilateral junction including: 1) a y-block, the y-block including; a) a housing having a first end and a second opposing end; b) a single first bore extending into the housing from the first end, the single first bore defining a first centerline; and c) second and third separate bores extending into the housing and branching off from the single first bore, the second bore defining a second centerline and the third bore defining a third centerline; 2) a mainbore leg coupled to the second bore for extending into the main wellbore; and 3) a lateral bore leg coupled to the third bore for extending into the lateral wellbore, the lateral bore leg including; a) a unitary housing having a first end and a second opposing end defining a length (L); and b) three or more bores formed in the housing and extending along the length (L).

C. A well system, the well system including: 1) a main wellbore; 2) a lateral wellbore extending from the main wellbore; 3) a multilateral junction positioned at an intersection of the main wellbore and the lateral wellbore, the multilateral junction including; 1) a y-block, the y-block including; i) a housing having a first end and a second opposing end; ii) a single first bore extending into the housing from the first end, the single first bore defining a first centerline; and iii) second and third separate bores extending into the housing and branching off from the single first bore, the second bore defining a second centerline and the third bore defining a third centerline; b) a mainbore leg coupled to the second bore for extending into the main wellbore; and c) a lateral bore leg coupled to the third bore for extending into the lateral wellbore, the lateral bore leg including; i) a unitary housing having a first end and a second opposing end defining a length (L); and ii) three or more bores formed in the housing and extending along the length (L).

Aspects A, B, and C may have one or more of the following additional elements in combination: Element 1: wherein the unitary housing has a center bore, a right bore, and a left bore. Element 2: wherein a centerpoint of each of the center bore, right bore and left bore are laterally offset from one another, and the centerpoint of the center bore is horizontally offset from the right bore and the left bore. Element 3: wherein a centerpoint of each of the center bore, right bore and left bore are laterally offset from one another, and the centerpoint of the center bore, right bore and left bore are horizontally aligned with each other. Element 4: wherein the center bore has a diameter ($d_c$), the right bore has a diameter ($d_r$), and the left bore has a diameter ($d_l$), and further wherein the diameter ($d_c$) is greater than the diameters ($d_r$) and ($d_l$). Element 5: wherein the center bore has a diameter ($d_c$), the right bore has a diameter ($d_r$), and the left bore has a diameter ($d_l$), and further wherein the diameter ($d_c$), diameter ($d_r$), and diameter ($d_l$) equal each other. Element 6: wherein the center bore has a diameter ($d_c$), the right bore has a diameter ($d_r$), and the left bore has a diameter ($d_l$), and further wherein the diameter ($d_c$), the diameter ($d_r$) and the diameter ($d_l$) differ from each other, the diameter ($d_c$) being the largest diameter. Element 7: wherein the center bore has a diameter ($d_c$), the right bore has a diameter ($d_r$), and the left bore has a diameter ($d_l$), and further wherein the diameter ($d_c$) is the smallest diameter and the diameter ($d_r$), and diameter ($d_l$) equal each other. Element 8: wherein the center bore, right bore and left bore do not overlap one another, and thus provide three separate flow paths and three separate tool paths. Element 9: wherein the center bore, right bore and left bore overlap one another to provide a single combined flow path but three separate tool paths. Element 10: wherein the housing is generally D-shaped. Element 11: wherein the generally D-shaped housing has an inner radial profile ($r_i$) and an outer radial profile ($r_o$). Element 12: wherein the outer radial profile ($r_o$) is operable to mimic an outer radial profile of a y-block the multilateral bore leg is coupled to. Element 13: wherein the inner radial profile ($r_i$) is operable to hug a radius of a mainbore leg the multilateral bore leg is deployed with. Element 14: wherein the mainbore leg couples to the second bore using one or more threads, and further wherein the lateral bore leg couples to the third bore using something other than the one or more threads. Element 15: wherein the unitary housing has a center bore, a right bore, and a left bore, and further wherein centerpoint of each of the center bore, right bore and left bore are laterally offset from one another, and the centerpoint of the center bore is horizontally offset from the right bore and the left bore. Element 16: wherein the center bore has a diameter ($d_c$), the right bore has a diameter ($d_r$), and the left bore has a diameter ($d_l$), and further wherein the diameter ($d_c$) is greater than the diameters ($d_r$) and ($d_l$). Element 17: wherein the center bore, right bore and left bore do not overlap one another, and thus provide three separate flow paths and three separate tool paths. Element 18: wherein the center bore, right bore and left bore overlap one another to provide a single combined flow path but three separate tool paths.

Those skilled in the art to which this application relates will appreciate that other and further additions, deletions, substitutions and modifications may be made to the described embodiments.

What is claimed is:

1. A multilateral bore leg, comprising:

a unitary housing having a first end and a second opposing end defining a length (L); and three or more bores formed in the unitary housing and extending along the length (L), the three or more bores of the unitary housing configured to extend out into a lateral wellbore near a junction between the lateral wellbore and a main wellbore, wherein the three or more bores include a center bore, a right bore, and a left bore, and further wherein the center bore, right bore and left bore overlap one another to provide a single combined flow path but three separate tool paths.

2. The multilateral bore leg as recited in claim 1, wherein a centerpoint of each of the center bore, right bore and left bore are laterally offset from one another, and the centerpoint of the center bore is horizontally offset from the right bore and the left bore.

3. The multilateral bore leg as recited in claim 1, wherein the center bore has a diameter ($d_c$), the right bore has a diameter ($d_r$), and the left bore has a diameter ($d_l$), and further wherein the diameter ($d_c$) is greater than the diameters ($d_r$) and ($d_l$).

4. The multilateral bore leg as recited in claim 1, wherein the center bore has a diameter ($d_c$), the right bore has a diameter ($d_r$), and the left bore has a diameter ($d_l$), and further wherein the diameter ($d_c$), diameter ($d_r$), and diameter ($d_l$) are equal to each other.

5. The multilateral bore leg as recited in claim 1, wherein the center bore has a diameter ($d_c$), the right bore has a diameter ($d_r$), and the left bore has a diameter ($d_l$), and further wherein the diameter ($d_c$), the diameter ($d_r$) and the diameter ($d_l$) differ from each other, the diameter ($d_c$) being the largest diameter.

6. The multilateral bore leg as recited in claim 1, wherein the center bore has a diameter ($d_c$), the right bore has a diameter ($d_r$), and the left bore has a diameter ($d_l$), and further wherein the diameter ($d_c$) is the smallest diameter and the diameter ($d_r$) and diameter ($d_l$) equal each other.

7. The multilateral bore leg as recited in claim 1, wherein the housing is generally D-shaped.

8. The multilateral bore leg as recited in claim 7, wherein the generally D-shaped housing has an inner radial profile ($r_i$) and an outer radial profile ($r_o$).

9. The multilateral bore leg as recited in claim 8, wherein the outer radial profile ($r_o$) is operable to mimic an outer radial profile of a y-block that the multilateral bore leg is coupled to.

10. The multilateral bore leg as recited in claim 9, wherein the inner radial profile ($r_i$) is operable to hug a radius of a mainbore leg the multilateral bore leg is deployed with.

11. A multilateral junction, comprising:

a y-block, the y-block including;

a housing having a first end and a second opposing end;

a single first bore extending into the housing from the first end, the single first bore defining a first centerline; and second and third separate bores extending into the housing and branching off from the single first bore, the second bore defining a second centerline and the third bore defining a third centerline;

a mainbore leg coupled to the second bore for extending into a main wellbore; and a lateral bore leg coupled to the third bore for extending into a lateral wellbore, the lateral bore leg including;

a unitary housing having a first end and a second opposing end defining a length (L); and three or more bores formed in the unitary housing and extending along the length (L), the three or more bores of the unitary housing configured to extend out into the lateral wellbore near a junction between the lateral wellbore and the main wellbore, wherein the three or more bores include a center bore, a right bore, and a left bore, and further wherein the center bore, right bore and left bore overlap one another to provide a single combined flow path but three separate tool paths.

12. The multilateral junction as recited in claim 11, wherein the mainbore leg couples to the second bore using one or more threads, and further wherein the lateral bore leg does not couple to the third bore using one or more threads.

13. The multilateral junction as recited in claim 11, wherein a centerpoint of each of the center bore, right bore and left bore are laterally offset from one another, and the centerpoint of the center bore is horizontally offset from the right bore and the left bore.

14. The multilateral junction as recited in claim 13, wherein the center bore has a diameter ($d_c$), the right bore has a diameter ($d_r$), and the left bore has a diameter ($d_l$), and further wherein the diameter ($d_c$) is greater than the diameters ($d_r$) and ($d_l$).

15. A well system, comprising:

a main wellbore;

a lateral wellbore extending from the main wellbore;

a multilateral junction positioned at an intersection of the main wellbore and the lateral wellbore, the multilateral junction, including:

a y-block, the y-block including;

a housing having a first end and a second opposing end;

a single first bore extending into the housing from the first end, the single first bore defining a first centerline; and second and third separate bores extending into the housing and branching off from the single first bore, the second bore defining a second centerline and the third bore defining a third centerline;

a mainbore leg coupled to the second bore for extending into the main wellbore; and a lateral bore leg coupled to the third bore for extending into the lateral wellbore, the lateral bore leg including;

a unitary housing having a first end and a second opposing end defining a length (L); and three or more bores formed in the unitary housing and extending along the length (L), the three or more bores of the unitary housing extending out into the lateral wellbore near the intersection between the lateral wellbore and the main wellbore, wherein the three or more bores include a center bore, a right bore, and a left bore, and further wherein the center bore, right bore and left bore overlap one another to provide a single combined flow path but three separate tool paths.

* * * * *